US010015845B2

(12) United States Patent
Kishimoto et al.

(10) Patent No.: US 10,015,845 B2
(45) Date of Patent: Jul. 3, 2018

(54) HEATING COOKER

(71) Applicant: SHARP KABUSHIKI KAISHA, Osaka-shi, Osaka (JP)

(72) Inventors: Takushi Kishimoto, Osaka (JP); Hiroyoshi Inoue, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 414 days.

(21) Appl. No.: 14/760,580

(22) PCT Filed: Feb. 3, 2014

(86) PCT No.: PCT/JP2014/052435
§ 371 (c)(1),
(2) Date: Jul. 13, 2015

(87) PCT Pub. No.: WO2014/123083
PCT Pub. Date: Aug. 14, 2014

(65) Prior Publication Data

US 2015/0359047 A1 Dec. 10, 2015

(30) Foreign Application Priority Data

Feb. 6, 2013 (JP) ..... 2013-021143

(51) Int. Cl.
*H05B 6/68* (2006.01)
*H05B 6/64* (2006.01)
(Continued)

(52) U.S. Cl.
CPC ..... *H05B 6/6447* (2013.01); *F24C 7/085* (2013.01); *H05B 6/6444* (2013.01); *H05B 6/725* (2013.01)

(58) Field of Classification Search
CPC .... H05B 6/6447; H05B 6/725; H05B 6/6444; F24C 7/085
(Continued)

(56) References Cited

U.S. PATENT DOCUMENTS 4,323,773 A * 4/1982 Carpenter ..... G05B 19/124 219/714
6,528,954 B1 * 3/2003 Lys ..... A61N 5/0616 315/158

FOREIGN PATENT DOCUMENTS

CN 102812298 A 12/2012
JP 59-90384 A 5/1984
(Continued)

OTHER PUBLICATIONS

Translation of WO2011/114682A1 (Panasonic Corp.), Sep. 22, 2011 , ProQuest Dialog.*
(Continued)

*Primary Examiner* — Quang Van
(74) *Attorney, Agent, or Firm* — Birch, Stewart, Kolasch & Birch, LLP

(57) ABSTRACT

The heating cooker includes: a heating compartment having a bottom tray mounted at the bottom part; a light source provided on the upper side of the heating compartment; a light-receiving element for receiving light transmitted by the bottom tray out of the light emitted from the light source, the light-receiving element being provided on the lower side of the bottom tray; and a determining part for determining, on the basis of a light-reception signal detected by the light-receiving element, the presence/absence or the size of a heating object placed on the bottom tray in the heating compartment. Thus, a heating cooker capable of preventing leakage of steam and detecting the presence/absence of food in the heating compartment, even when heat cooking using steam is performed, is provided.

4 Claims, 19 Drawing Sheets

(51) Int. Cl.
*H05B 6/72* (2006.01)
*F24C 7/08* (2006.01)

(58) Field of Classification Search
USPC ..... 219/704, 711, 714, 720, 754, 758
See application file for complete search history.

(56) References Cited

FOREIGN PATENT DOCUMENTS

| | | | |
|---|---|---|---|
| JP | 59-108293 | A | 6/1984 |
| JP | 07-055159 | A | 3/1995 |
| JP | 2003-161446 | A | 6/2003 |
| JP | 2003-287232 | A | 10/2003 |
| JP | 2012-042146 | A | 3/2012 |
| WO | WO 2011/114682 | A1 | 9/2011 |

OTHER PUBLICATIONS

Translation of JP_2017004834_A (Tiger Corp.), Mar. 3, 1995, ProQuest Dialog.*
Translation of JP_59-108293A (Sharp Corp.), May 24, 1984, ProQuest Dialog.*
International Search Report issued in PCT/JP2014/052435 dated Mar. 18, 2014.

* cited by examiner

ROTATIONAL ANGLE: 108 deg

HEATING COOKER

TECHNICAL FIELD

The present invention relates to a heating cooker.

BACKGROUND ART

Conventionally, there has been provided a heating cooker for heating foods by using a heating plate on which a high-frequency heat generator is attached, the heating cooker including a light-receiving element provided outside the heating compartment so as to face inside of the heating compartment, wherein based on an output of the light-receiving element as to its detected brightness inside the heating compartment, it is decided whether or not the heating plate has been set in the heating compartment (see, e.g., JP 2012-42146 A (PTL 1)). Upon a decision as to whether or not the heating plate has been set in the heating compartment, if it is decided that the heating plate has not been set in the heating compartment, this heating cooker is enabled to decrease or stop the heating power.

CITATION LIST

Patent Literature

PTL1: JP 2012-42146 A

SUMMARY OF INVENTION

Technical Problem

However, the above-described heating cooker is unable to detect the presence or absence of any food itself and moreover has a need for providing an opening in the wall surface of the heating compartment with the light-receiving element set outside the heating compartment. As a result, doing heat cooking with use of steam may involve occurrence of steam leaks that may lead to a decrease in heating efficiency or degradation of reliability, problematically.

Accordingly, an object of the invention is to provide a heating cooker capable of detecting the presence or absence of any food in the heating compartment while preventing steam leaks even in heat cooking with use of steam.

Solution to Problem

In order to solve the problem, a heating cooker according to the present invention comprises:

a heating compartment;

a bottom tray having light transmittability and attached to a bottom portion of the heating compartment;

a light source provided on an upper side of the heating compartment or on a lower side of the bottom tray;

at least one light-receiving element which is provided on the lower side of the bottom tray and which receives light transmitted by the bottom tray out of light emitted from the light source; and a determining part for, based on a light-reception signal detected by the light-receiving element, determining presence/absence or size of a heating object set on the bottom tray within the heating compartment.

In the heating cooker according to one embodiment, the heating cooker has a plurality of light-receiving elements.

The heating cooker according to one embodiment further comprises a heat insulating member provided on the lower side of the bottom tray with a gap therebetween, wherein the light-receiving element is disposed at a bottom portion of a recess extending through the heat insulating member.

The heating cooker according to one embodiment further comprises:

an antenna chamber provided on the lower side of the bottom tray in the heating compartment; and a rotating antenna rotatably attached in the antenna chamber and having a plurality of openings, wherein the light-receiving element is disposed on a lower side of the rotating antenna, and the light-receiving element placed inner than an outer peripheral edge of the rotating antenna is located at such a position as to be enabled to receive light, which is derived from within the heating compartment and transmitted by the bottom tray, via a region of a rotational locus of the openings of the rotating antenna.

In the heating cooker according to one embodiment, at a start of heat cooking, the determining part turns on the light source and determines presence/absence or size of the heating object set on the bottom tray within the heating compartment.

In the heating cooker according to one embodiment, a plurality of the light-receiving elements are disposed in at least one line with intervals in a back-and-forth direction along the bottom face of the heating compartment, and a plurality of the light-receiving elements are disposed in at least one line with intervals in a left-and-right direction along the bottom face of the heating compartment.

Advantageous Effects of Invention

As apparent from the above description, according to this invention, a light-receiving element for receiving light transmitted by the bottom tray out of light emitted from the light source is provided on the lower side of the bottom tray attached at the bottom portion of the heating compartment and, based on a light-reception signal detected by the light-receiving element, the determining part determines the presence/absence or size of a heating object set on the bottom tray within the heating compartment. As a result of this, there can be realized a heating cooker capable of detecting the presence or absence of a food in the heating compartment while preventing steam leaks even in heat cooking with use of steam.

DESCRIPTION OF EMBODIMENTS

Hereinbelow, the heating cooker of the present invention will be described in detail by embodiments thereof illustrated in the accompanying drawings.

(First Embodiment)

Figure 1:
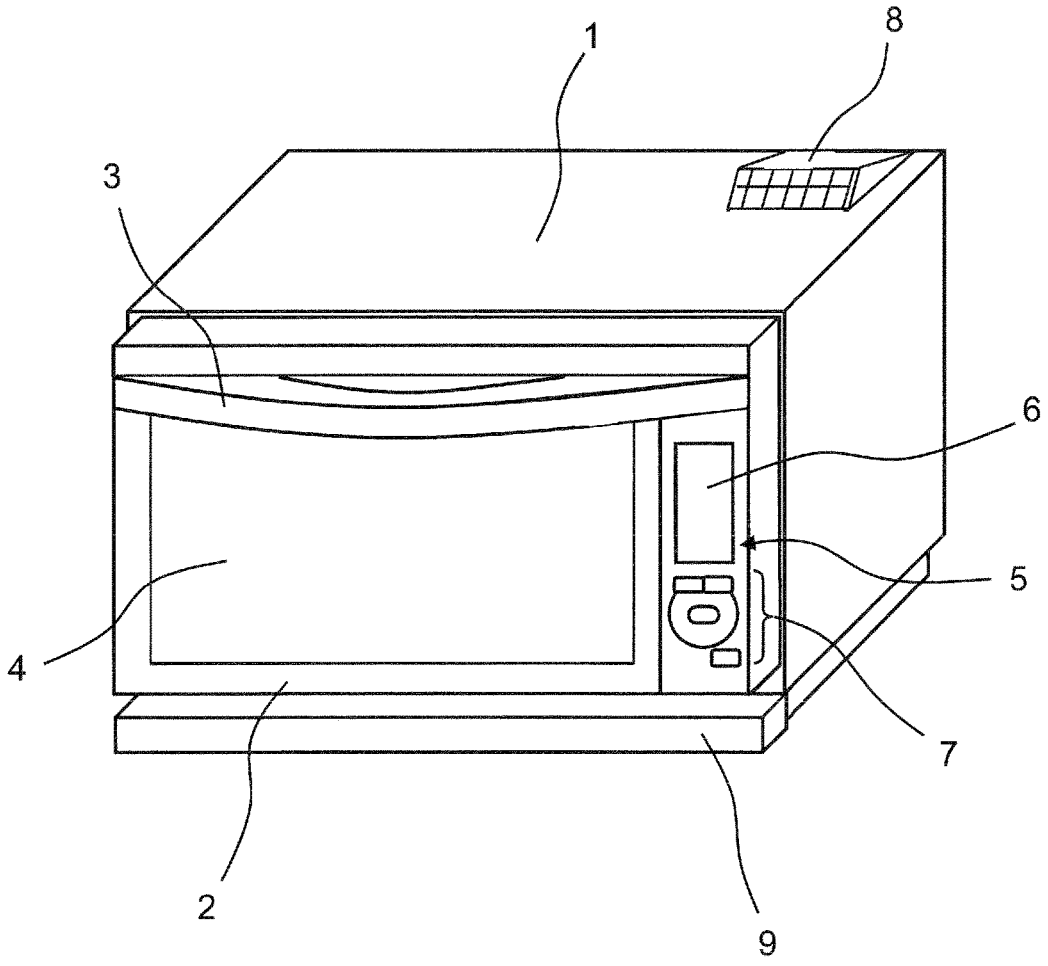
FIG. 1 is a front perspective view of a heating cooker according to a first embodiment of the present invention.

FIG. 1 is a front perspective view of a heating cooker according to a first embodiment of the invention.

In the heating cooker of this embodiment, as shown in FIG. 1, a door 2 which pivots generally about a lower end-side line is attached to the front of a rectangular parallelepiped-shaped casing 1. A handle 3 is attached at an upper portion of the door 2, and a heat-resistant glass 4 is attached at a generally center of the door 2. Also, an operation panel 5 is provided on the right side of the door 2. The operation panel 5 has a color LCD (Liquid Crystal Display) part 6 and a button group 7. An exhaust duct cover 8 is provided in an upper and right-side rear of the casing 1. Further, a dew receiving container 9 is removably attached to the casing 1 under the door 2.

Figure 2:
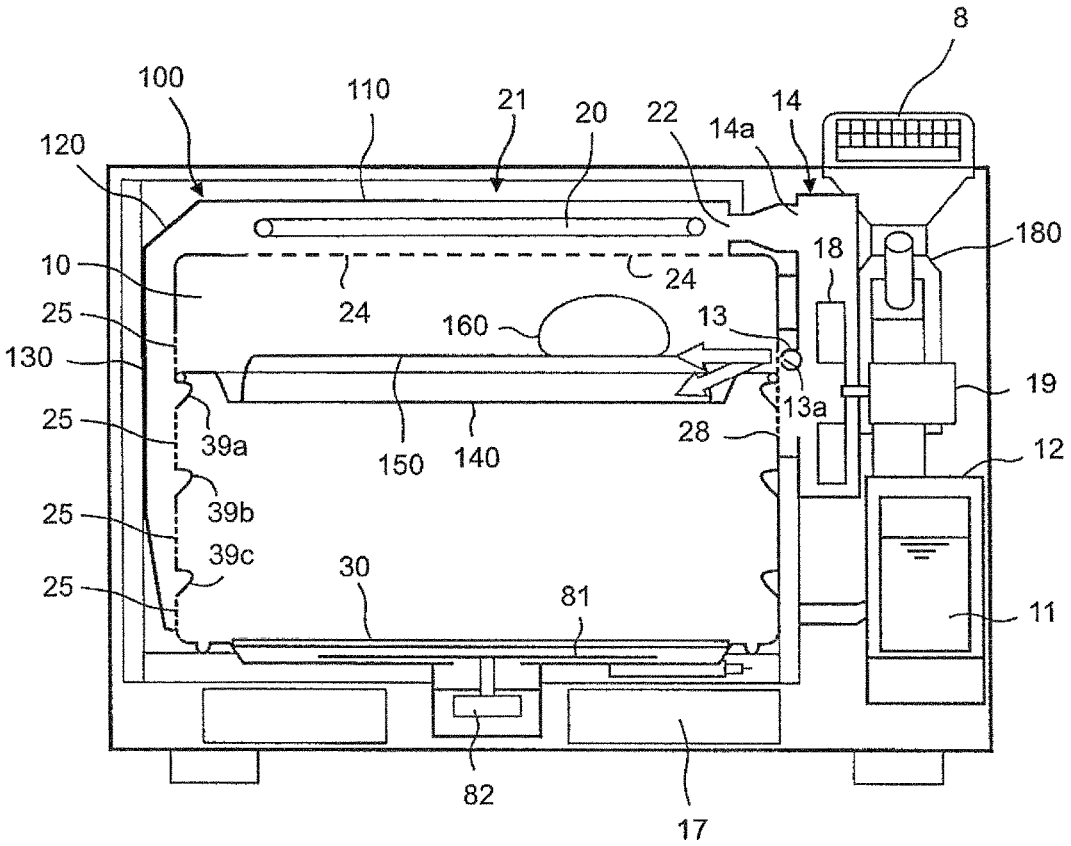
FIG. 2 is a longitudinal sectional view of the heating cooker as viewed from the front.

FIG. 2 is a schematic longitudinal sectional view of the heating cooker as viewed from its front.

As shown in FIG. 2, a water supply tank 11 removably inserted from the frontal side is placed on the right side of a heating compartment 10, and a steam generator 12 is placed on the rear face side of the water supply tank 11. The steam generator 12, connected to the water supply tank 11, generates steam by heating of a heater (not shown). One end of a steam supply passage 13 is connected to the steam generator 12, and the other end of the steam supply passage 13 is connected to a circulation unit 14.

Water supplied from the water supply tank 11 is heated by the steam generator 12 to generate saturated steam. The saturated steam generated in the steam generator 12 is supplied via the steam supply passage 13 from a steam supply port 13*a* to the downstream side of a suction port 28. The suction port 28 is provided at a central portion of a right side wall of the heating compartment 10.

The steam supply port 13*a* of the steam supply passage 13 is placed in proximity to the suction port 28. Also, in the circulation unit 14, a circulation fan 18 is placed so as to face the suction port 28. The circulation fan 18 is driven by a circulation-fan motor 19.

A steam duct 100 bent in an L-like shape is attached so as to cover the top face and left side face of the heating compartment 10. The steam duct 100 has a first duct portion 110 fixed on the top face side of the heating compartment 10, a bent portion 120 bent downward from the left side of the first duct portion 110, and a second duct portion 130 fixed on the left side face side of the heating compartment 10 and adjoining via the bent portion 120 to the first duct portion 110.

In the first duct portion 110 of the steam duct 100, a superheated steam generation heater 20 formed of a sheath heater or the like is housed. The first duct portion 110 of the steam duct 100 and the superheated steam generation heater 20 constitute a superheated steam generator 21. In addition, the superheated steam generator may be provided independently of the steam duct.

The right side of the first duct portion 110 of the steam duct 100 is communicated with a steam supply port 14*a* provided in upper portion of the circulation unit 14. A plurality of first steam blowoff holes 24 are provided in the ceiling surface of the heating compartment 10, and the first duct portion 110 of the steam duct 100 is communicated with inside of the heating compartment 10 via the first steam blowoff holes 24. On the other hand, the second duct portion 130 of the steam duct 100 is communicated with inside of the heating compartment 10 via a plurality of second steam blowoff holes 25 provided in the left side face of the heating compartment 10. Also, engaging portions 39*a*, 39*b*, 39*c* for engagement of both end portions of a tray 140 are provided vertically in three stages on left wall surface and right wall surface in the heating compartment 10.

Further, a bottom tray 30 formed of ceramic that transmits light of the infrared region is attached at a bottom portion of the heating compartment 10.

A gap between the heating compartment 10 and the steam duct 100 is sealed by heat-resistant resin or the like. Also, the heating compartment 10 and the steam duct 100 are covered with a heat insulating material except the front opening of the heating compartment 10.

The circulation unit 14, the steam duct 100, the heating compartment 10 and connecting members for connecting those components make up a circulation path for the heating medium. Then, saturated steam generated in the steam generator 12 is supplied to a boundary portion of the circulation unit 14 that abuts on the heating compartment 10 in the circulation path.

In this connection, the heating medium may be heated air or steam-containing heated air or superheated steam-containing air heated to over 100° C., or further may be mostly superheated steam heated to over over 100° C.

A magnetron 80 (shown in FIG. 3) as an example of the microwave generator section is placed in lower portion of the heating compartment 10. Microwaves generated in the magnetron 80 are led to a lower center of the heating compartment 10 by a waveguide (not shown) and, while being stirred by a rotating antenna 81, radiated upward within the heating compartment 10 to heat a heating object 160. In a case of heat cooking with the microwaves, the heating object 160 is set at the bottom portion in the heating compartment 10. The rotating antenna 81 is driven by a rotating-antenna motor 82.

Also, an air supply port (not shown) is provided on the front side of the suction port 28 in the right side wall of the heating compartment 10, and a first exhaust port (not shown) is provided on the rear side of the suction port 28. The air supply port is located near the door 2 (shown in FIG. 1) so that outside air blown out through the air supply port flows into the heating compartment 10 along the door 2. Also, a second exhaust port (not shown) smaller in opening area than the first exhaust port is provided on the lower right side of the rear side wall surface of the heating compartment 10. An exhaust duct cover 8 is removably attached at an upper end of an exhaust duct 180 adjoining the first, second exhaust ports.

The circulation-fan motor 19 for driving the circulation fan 18 is attached to the circulation unit 14 placed on the right side face of the heating compartment 10. By this circulation fan 18, steam and air in the heating compartment 10 are sucked in through the suction port 28 and blown out through the first, second steam blowoff holes 24, 25 via the steam duct 100 into the heating compartment 10. Further, an interior temperature sensor 29 (shown in FIG. 3) for detecting a temperature of the heating medium (steam-containing air) in the heating compartment 10 is placed near the suction port 28 of the circulation unit 14.

The heating object 160 in the heating compartment is heated by radiant heat of the superheated steam generation heater 20 placed in the first duct portion 110 of the steam duct 100. Also, the heating medium (steam-containing air) passing through the steam duct 100 is heated by the superheated steam generation heater 20, and the heated heating medium is blown out through the first, second steam blowoff holes 24, 25. As a result of this, the heating medium in the heating compartment 10 is maintained at a specified temperature. Also, steam supplied to the heating compartment 10 is further increased in temperature by the superheated steam generation heater so that superheated steam of over 100° C. can be generated.

A cooling fan part (not shown) and an electrical equipment part 17 are placed on the lower side in the casing 1. An air flow duct (not shown) is placed on the right side of the heating compartment 10 in the casing 1. Housed in this air flow duct are a dilution fan (not shown) and a dilution-fan motor for driving the dilution fan. The cooling fan part has a cooling fan (not shown), and a cooling-fan motor 16 (shown in FIG. 3) for driving the cooling fan.

The electrical equipment part 17 includes a drive circuit for driving individual parts of the heating cooker, a control circuit for controlling the drive circuit, and the like. The cooling fan takes in outside air into the casing 1 to cool the heat-generating electrical equipment part 17 and magnetron 80. Also, part of the outside air taken into the casing 1 by the cooling fan is led into the air flow duct by the dilution fan while the rest of the outside air is exhausted outside through an opening (not shown) formed in the back face of the casing 1 or the like. The outside air led into the air flow duct by the dilution fan merges into the exhaust duct 180 so as to be mixed with exhaust air, so that the exhaust air is diluted.

Figure 3:
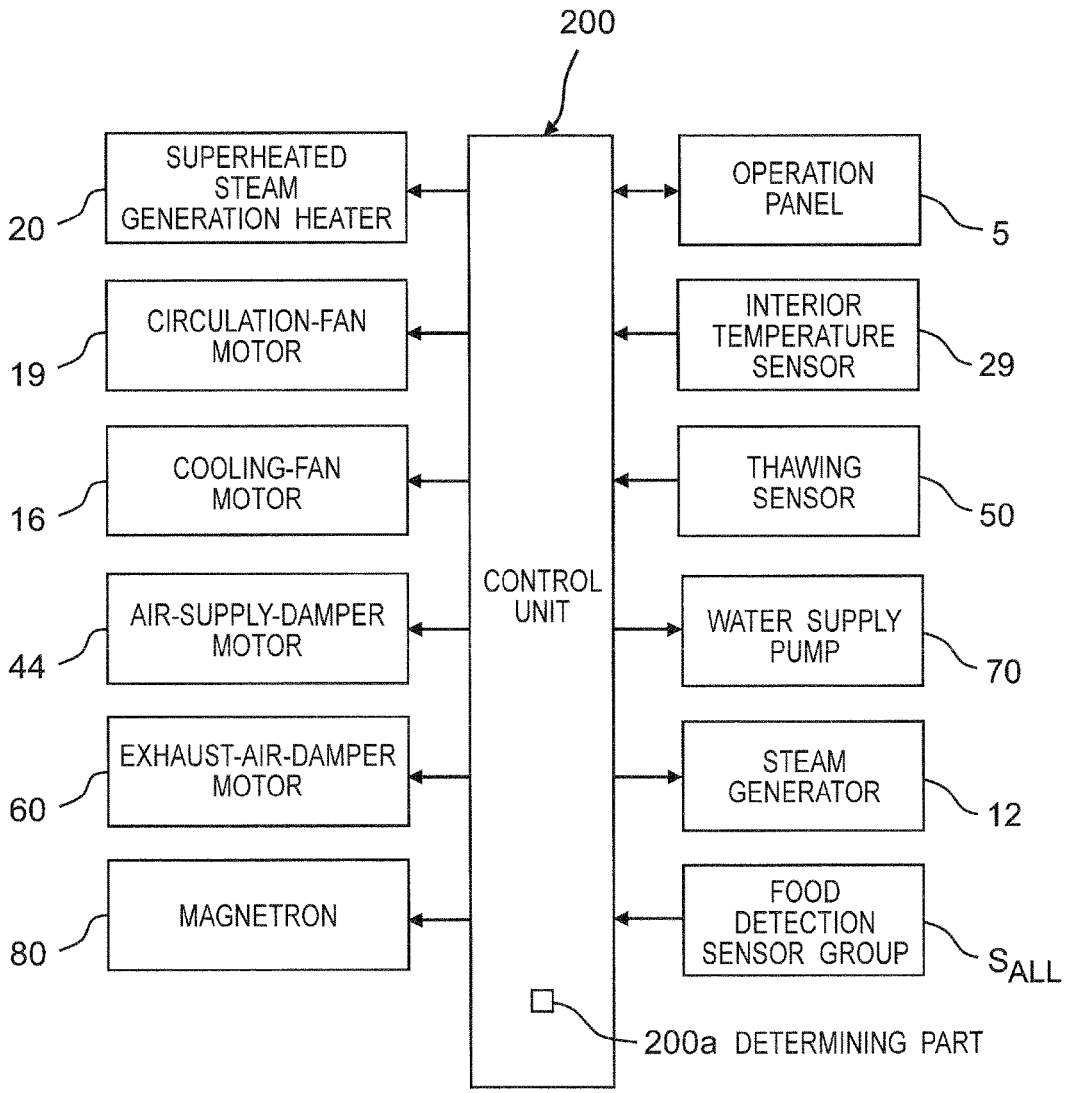
FIG. 3 is a control block diagram of the heating cooker.

FIG. 3 is a control block diagram of this heating cooker. In the electrical equipment section 17 (shown in FIG. 2), the heating cooker has a control unit 200 composed of a microcomputer, input/output circuits and the like. Connected to the control unit 200 are the superheated steam generation heater 20, the circulation-fan motor 19, the cooling-fan motor 16, an air-supply-damper motor 44, an exhaust-air-damper motor 60, the operation panel 5, the interior temperature sensor 29, a thawing sensor 50, a water supply pump 70, the steam generator 12 and magnetron 80, and an indoor light 40. Based on a signal from the operation panel 5 as well as detection signals from the interior temperature sensor 29, the thawing sensor 50 and a food detection sensor group $S_{ALL}$, the control unit 200 controls the superheated steam generation heater 20, the circulation-fan motor 19, the cooling-fan motor 16, the air-supply-damper motor 44, the exhaust-air-damper motor 60, the operation panel 5, the water supply pump 70, the steam generator 12 and magnetron 80, and the like.

Figure 7:
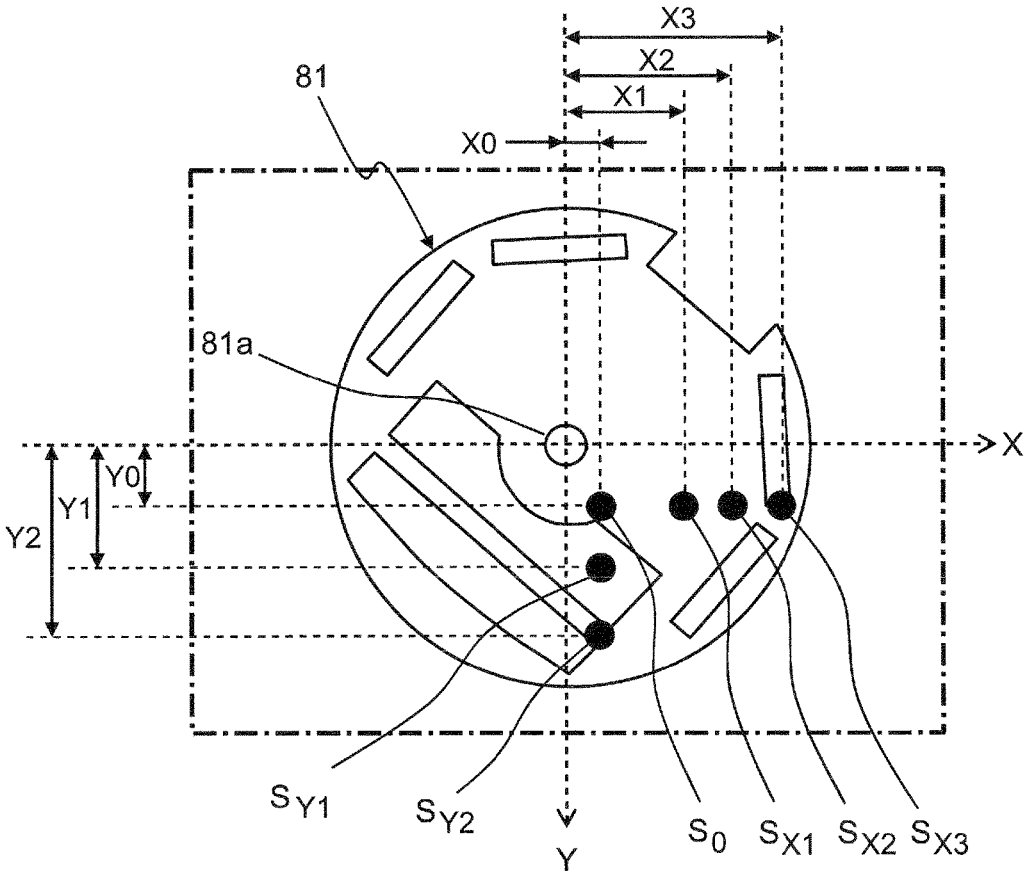
FIG. 7 is a top view for explaining the rotating antenna and positions of sensor parts in the heating cooker.

In addition, the food detection sensor group $S_{ALL}$ refers to sensor parts $S_0$, $S_{X1}$, $S_{X2}$, $S_{X2}$, $S_{Y1}$ and $S_{Y2}$ shown in FIG. 7.

The control unit 200 has a determining part 200*a* for deciding presence or absence and size of a heating object set on the bottom tray 30 within the heating compartment 10.

In the heating cooker having the above-described constitution, for execution of heat cooking with superheated steam, the superheated steam generation heater shown in FIG. 2 is turned on and moreover the circulation fan 18 is driven into rotation. Then, saturated steam supplied from the steam generator 12 toward the upstream side of the circulation unit 14 near the steam suction port is sucked via the steam supply port into the circulation unit 14, which has been put into a negative pressure by rotation of the circulation fan 18, and then blown out through a steam supply port 22 into the superheated steam generator 21. Then, the saturated steam is heated by the superheated steam generation heater 20 of the superheated steam generator 21 so as to be superheated steam. Part of the superheated steam is blown out downward into the heating compartment 10 through the plurality of first steam blowoff holes 24 provided in the lower-side ceiling surface of the heating compartment 10. Also, another part of the superheated steam blown out into the heating compartment 10 through the second steam blowoff holes 25 of the heating compartment 10 via the steam duct 100.

Then, the superheated steam supplied into the heating compartment 10, after having heated the heating object 160 set on a net 150 on the tray 140, sucked into the circulation unit 14 through the suction port 28 formed in the right wall surface of the heating compartment 10. Thus, the circulation of passing through the circulation path again and returning into the heating compartment 10 is repeated.

In contrast to this, for the operation of steaming or warming the heating object 160 by non-superheated steam, the superheated steam generation heater 20 is turned off and moreover the circulation fan 18 is stopped. Then, since the circulation fan 18 is stopped, there is never generated any circulating air flow within the circulation path, so that the saturated steam supplied from the steam generator 12 to the upstream side of the circulation unit 14 near the steam supply port is not forcedly sucked into the circulation unit 14. As a result of this, the heating object 160 is steamed or warmed by saturated steam flowing into the heating compartment 10 naturally by steam pressure.

Also in the heating cooker, for execution of thawing cooking with use of microwaves, a frozen food or the like, which is a heating object, is set on the bottom tray 30 of the heating compartment 10 as it is in a wrapped state. Then, the frozen food is heated with a specified microwave power based on a food weight obtained by a later-described food weight detection process.

Figure 4:
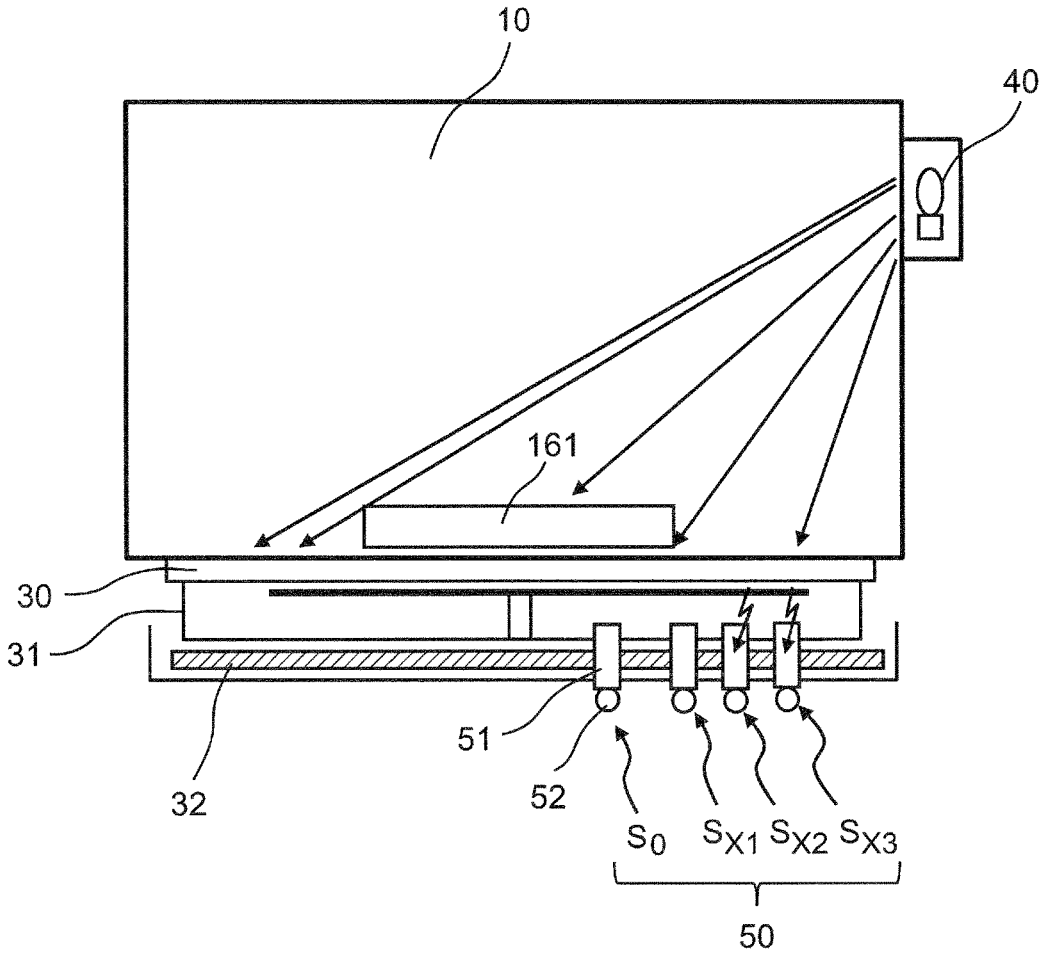
FIG. 4 is a schematic longitudinal sectional view of main part of the heating cooker as viewed from the front.

FIG. 4 is a schematic longitudinal sectional view of main part of the heating cooker as viewed from the front, As shown in FIG. 4, the bottom tray 30, which is formed of ceramic that transmits infrared rays, is attached at a bottom portion of the heating compartment 10. An antenna chamber 31 is also provided on the lower side of the bottom tray 30 of the heating compartment 10. The rotating antenna 81 is rotatably attached in the antenna chamber 31. Further, a plate-shaped heat insulating member 32 is placed on the lower side of the antenna chamber 31.

An indoor light 40 is also provided as a light source placed on the upper and outer side of the right side wall of the heating compartment 10. Light from the light source illuminates the interior of the heating compartment 10 via a window (not shown) provided in the right side wall of the heating compartment 10. This window is covered with a transparent glass or the like which seals the gap to the heating compartment 10. In addition, the illuminating light of the indoor light 40 contains infrared-region components in addition to visible light that illuminates the interior of the heating compartment 10.

Then, light-receiving elements 52 having a peak sensitivity in the infrared region are placed in bottom portions, respectively, of tubular light guide paths 51 formed from ABS resin extending through the heat insulating member 32. Each tubular light guide path 51 is set to a length of 6 mm, and its opening is set to an inner diameter of 4 mm so as to prevent leakage of electric waves. The tubular light guide path 51 and a light-receiving element 52 constitute a sensor part $S_0$. Sensor parts $S_{X1}$, $S_{X2}$, $S_{X3}$ similar in makeup to the sensor part $S_0$ are disposed with intervals in one line in the left-and-right direction.

The tubular light guide path 51 extending through the heat insulating member 32 is an example of a recess at which the light-receiving element is placed at its bottom portion.

In addition, each tubular light guide path 51 may have a mirror-finished inner circumference, by which reflectivity for incident light may be enhanced, making it possible to maintain the light-reception intensity regardless of the shape and length of the light guide path. Therefore, by laterally bending and elongating the light guide path, influences of high heat on the light-receiving elements from the heating compartment 10 can be suppressed so that precision and reliability of heating object detection can be improved.

With the structure shown in FIG. 4, although the light-reception intensity with no heating object present has proved to be 40% lower than that of the light-receiving elements placed on the bottom tray 30 of the heating compartment 10, yet there is a large difference from the light-reception intensity with a heating object present, making it possible to make a decision as to the presence or absence of a heating object.

Figure 5:
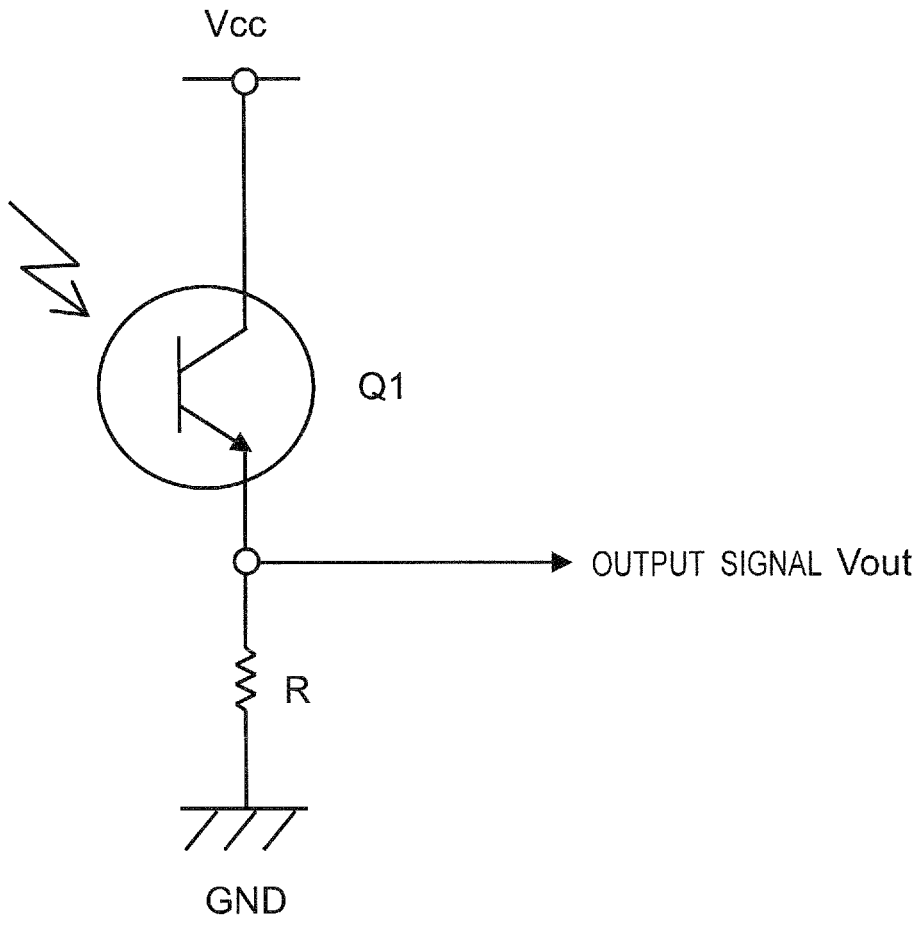
FIG. 5 is a circuit diagram of a sensor part using a phototransistor in the heating cooker.

FIG. 5 is a circuit diagram of a sensor part using a phototransistor Q1 as an example of the light-receiving elements 52 in this heating cooker. As shown in FIG. 5, a power supply voltage Vcc is applied to a collector terminal of the phototransistor Q1, and ground GND is connected to an emitter terminal of the phototransistor Q1 via a resistor R. An output signal Vout is outputted from the emitter terminal of the phototransistor Q1.

Figure 6:
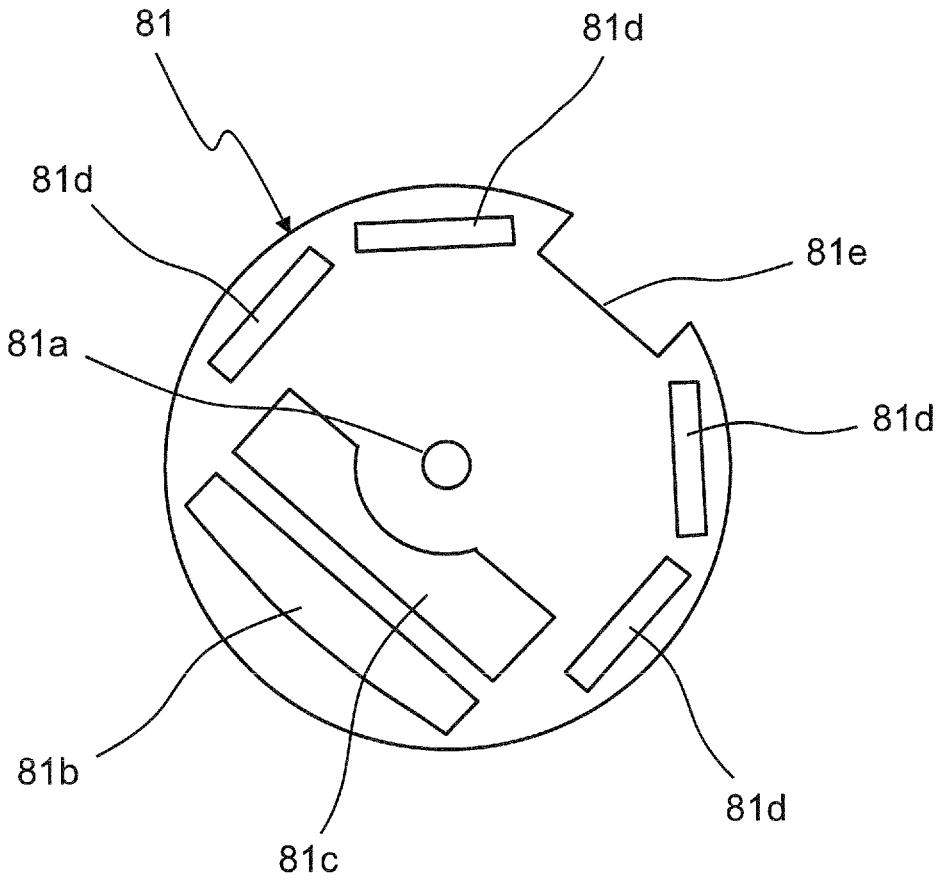
FIG. 6 is a top view of a rotating antenna of the heating cooker.

FIG. 6 is a top view of the rotating antenna 81 of the heating cooker. AS shown in FIG. 6, this rotating antenna 81 is formed into a disc shape, having a rotating shaft 81*a*, large-sized openings 81*b*, 81*c* adjacent to each other with a distance therebetween along the radial direction, four small-sized openings 81*d* placed along the circumferential direction, and a cutout 81*e* provided among the small-sized openings 81*d*. These openings 81*b*, 81*c*, 81*d* and cutout 81*e* are so designed that microwaves led from the magnetron 80 via the waveguide (not shown) to the lower center of the heating compartment 10 are stirred so as to uniformly irradiate the heating object in the heating compartment 10.

FIG. 7 is a top view for explaining the rotating antenna and positions of the sensor parts $S_{X1}$, $S_{X2}$, $S_{X3}$ in the heating cooker. Referring to FIG. 7, XY coordinates are represented by an X axis extending in the left-and-right direction along the bottom face of the heating compartment 10 (shown in FIG. 2), and a Y axis extending in the back-and-forth direction along the bottom face of the heating compartment 10 (shown in FIG. 2), where a center of the XY coordinates is assumed as a rotational center (rotational axis 81*a*) of the rotating antenna 81.

As shown in FIG. 7, the XY coordinates of the sensor part $S_0$ are (X0, Y0), the XY coordinates of the sensor part $S_{X1}$ are (X1, Y0), the XY coordinates of the sensor part $S_{X2}$ are (X2, Y0), and the XY coordinates of the sensor part $S_{X3}$ are (X3, Y0). Also, the XY coordinates of the sensor part $S_{Y1}$ are (X0, Y1), and the XY coordinates of the sensor part $S_{Y2}$ are (X0, Y2).

Next, with reference to FIGS. 8A to 8F, the principle of detecting the food weight in the heating cooker will be described below.

In FIGS. 8A to 8F, for an easier understanding of the description, food weights are detected by using only the sensor parts $S_0$, $S_{X1}$, $S_{X2}$ and $S_{Y1}$ under the conditions of heating objects 162, 163, 164, 165-1, 165-2, 166-1, 166-2, which are different in size and shape thereamong as well as under a condition of no heating object.

Figure 8A:
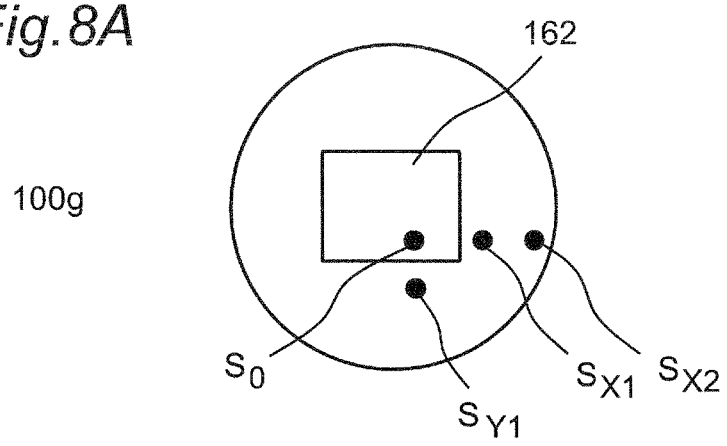
FIG. 8A is a schematic view for explaining a principle of detecting food weight in the heating cooker.

First, in FIG. 8A, when a heating object 162 formed into a generally rectangular shape longer in the left-and-right direction is set at a generally center of the bottom face of the heating compartment 10 (shown in FIG. 2), the sensor parts $S_{X1}$, $S_{X2}$, $S_{Y1}$ other than the sensor part $S_0$ receive light derived from the indoor light 40 and transmitted by the bottom tray 30 (shown in FIG. 4).

Figure 8B:
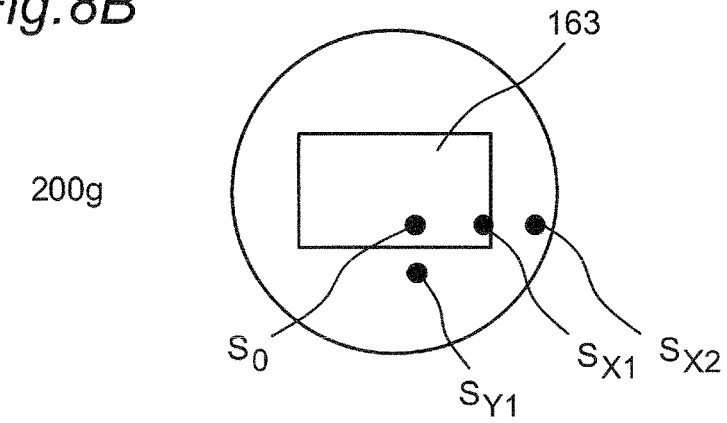
FIG. 8B is a schematic view for explaining a principle of detecting food weight in the heating cooker.

Also in FIG. 8B, when a heating object 163 larger in longitudinal (left-and-right direction) size than the heating object 162 is set at a generally center of the bottom face of the heating compartment 10 (shown in FIG. 2), the sensor parts $S_{X2}$, S than the sensor parts $S_0$, $S_{X1}$ receive light derived from the indoor light 40 and transmitted by the bottom tray 30.

Figure 8C:
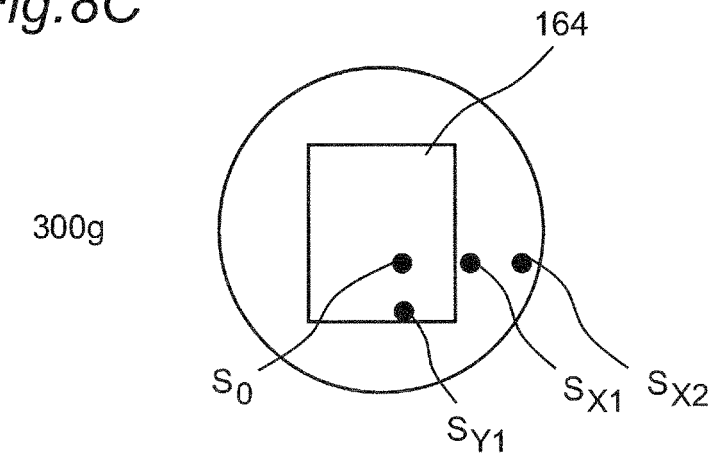
FIG. 8C is a schematic view for explaining a principle of detecting food weight in the heating cooker.

Also in FIG. 8C, when a heating object 164 larger than the heating objects 161, 162 is set at a generally center of the bottom face of the heating compartment 10 (shown in FIG. 2), the sensor parts $S_{X1}$, $S_{X2}$ other than the sensor parts $S_0$, $S_{Y1}$ receive light derived from the indoor light 40 and transmitted by the bottom tray 30.

Figure 8D:
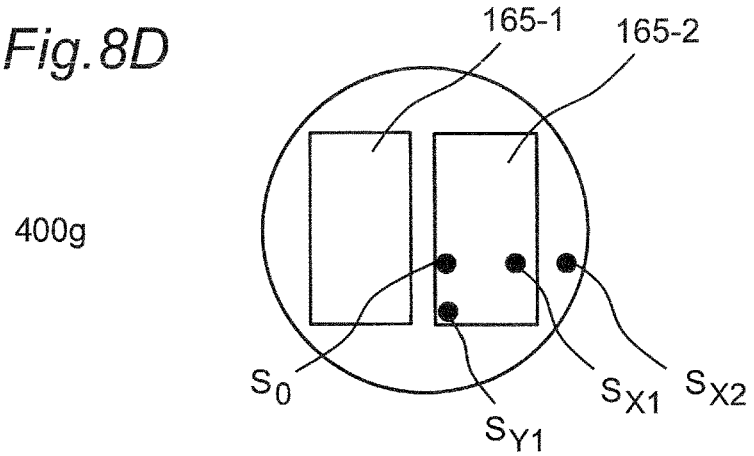
FIG. 8D is a schematic view for explaining a principle of detecting food weight in the heating cooker.
Figure 8E:
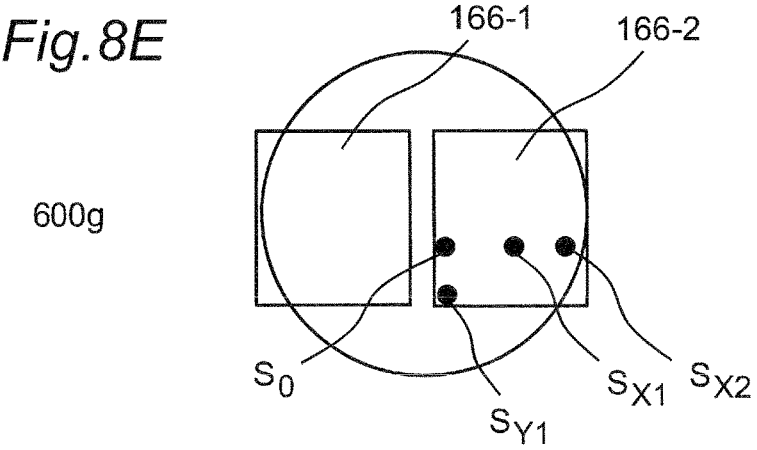
FIG. 8E is a schematic view for explaining a principle of detecting food weight in the heating cooker.

Also in FIG. 8D, when heating objects 165-1, 165-formed into a generally rectangular shape larger and back-and-forth longer than the heating object 162 are set in left-and-right juxtaposition at a generally center of the bottom face of the heating compartment 10 (shown in FIG. 2), the sensor part $S_{X2}$ other than the sensor parts $S_0$, $S_{X1}$, $S_{Y1}$ receive light derived from the indoor light 40 and transmitted by the bottom tray 30, Also in FIG. 8E, when heating objects 166-1, 166-2 larger than the heating objects 165-1, 165-2 are set in left-and-right juxtaposition at a generally center of the bottom face of the heating compartment 10 (shown in FIG. 2), all of the sensor parts $S_0$, $S_{X1}$, $S_{X2}$, $S_{Y1}$ does not receive light derived from the indoor light 40 and transmitted by the bottom tray 30.

Figure 8F:
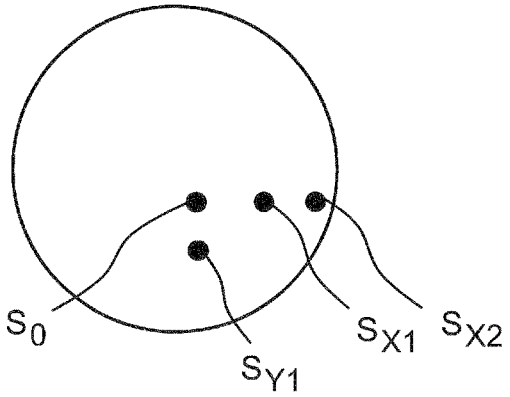
FIG. 8F is a schematic view for explaining a principle of detecting food weight in the heating cooker.

Further in FIG. 8F, when no heating object is set on the bottom face of the heating compartment 10 (shown in FIG. 2), all of the sensor parts $S_0$, $S_{X1}$, $S_{X2}$, $S_Y$) receive light derived from the indoor light 40 and transmitted by the bottom tray 30.

As a result of this, for example, it is implementable to make a six-stage simplified decision on food weight, where the weight of the heating object 162 is determined as 100 g in FIG. 8A, the weight of the heating object 163 is determined as 200 g in FIG. 8B, the weight of the heating object 164 is determined as 300 g in FIG. 8C, the weight of the heating objects 165-1, 165-2 is determined as 400 g in FIG. 8D, the weight of the heating objects 166-1, 166-2 is determined as 600 g in FIG. 8E, and no heating object is found in FIG. 8F.

Therefore, the heating cooker of this embodiment is enabled to make a 6-stage simplified description on food weight by structurally providing the sensor parts $S_0$, $S_{X1}$, $S_{X2}$, $S_{X3}$, $S_{Y1}$, $S_{Y2}$.

According to the heating cooker having the above-described constitution, the light-receiving elements 52 for receiving light transmitted by the bottom tray 30 out of light emitted from the indoor light 40 are provided on the lower side of the bottom tray 30 attached at the bottom portion of the heating compartment 10. Based on light-reception signals detected by the light-receiving elements 52, the presence or absence and size of a heating object set on the bottom tray 30 within the heating compartment 10 is determined by the determining part 200*a*. Since the light-receiving elements 52 are completely isolated from the heating compartment 10 by the bottom tray 30, the heating cooker is enabled to detect the presence or absence and size of any food in the heating compartment 10 while preventing steam leaks even in heat cooking with use of steam. Moreover, the light-receiving elements 52 are free from direct influences of dirts in the heating compartment 10.

Also, by arraying the plurality of light-receiving elements 52 with intervals from each other along the bottom face of the heating compartment 10, it becomes achievable to detect not only the presence or absence but also size of a heating object.

Also, by providing the light guide paths 51 that extend through the heat insulating member 32 provided on the lower side of the bottom tray 30 with a gap therebetween and by arranging the light-receiving elements 52 at bottom portions of the light guide paths 51, the light-receiving elements 52 can be prevented from being deteriorated in reliability or damaged due to their exposure to high heat of the heating compartment 10.

Also, the light-receiving elements 52 are placed on the lower side of the rotating antenna 81 rotatably attached in the antenna chamber 31 and moreover the sensor parts $S_0$, $S_{X1}$, $S_{X2}$, $S_{X3}$, $S_{Y1}$, $S_{Y2}$ inner than the outer peripheral edge of the rotating antenna 81 are placed at positions where light transmitted from within the heating compartment 10 through the bottom tray 30 is received via the rotational-locus region of the opening of the rotating antenna 81. As a result of this, by making the rotating antenna 81 rotated by at least one turn, the presence or absence and size of a heating object by the sensor parts $S_0$, $S_{X1}$, $S_{X2}$, $S_{X3}$, $S_{Y1}$, $S_{Y2}$ placed inner than the outer peripheral edge of the rotating antenna 81 can be determined depending on whether or not output levels representing light-reception intensities of the individual sensor parts $S_0$, $S_{X1}$, $S_{X2}$, $S_{X3}$, $S_{Y1}$, $S_{Y2}$ are equal to or higher than a specified threshold during one turn. Thus, a heating object set at an area on the bottom face within the heating compartment 10 and facing the rotating antenna 81.

Further, at a start of heat cooking, the determining part 200*a* determines the presence/absence or size of a heating object set on the bottom tray 30 within the heating compartment 10 by turning on the indoor light 40 immediately after the heating start key is inputted. Therefore, heating can be stopped in case no heating object is present at a start of heat cooking, and moreover heat cooking can be executed with a heating condition (e.g., food weight) set based on the size of the heating object at a start of heat cooking.

Also, as shown in FIG. 7, by the disposition that a plurality of light-receiving elements 52 are disposed in one line with intervals in the back-and-forth direction along the bottom face of the heating compartment 10 while a plurality of light-receiving elements 52 are disposed in one line with intervals in the left-and-right direction along the bottom face of the heating compartment 10, it is possible to detect, in divided multiple steps, the size of a heating object set on the bottom tray 30 within the heating compartment 10.

Also, by disposing the light-receiving elements 52 at a plurality of places differing in distance from the rotational center of the rotating antenna 81 and by determining whether or not heating objects are present at the individual positions, it is possible to determine the presence or absence of a heating object as well as the size of the heating object.

In the first embodiment, a plurality of light-receiving elements 52 are disposed in one line with intervals in the back-and-forth direction along the bottom face of the heating compartment 10 while a plurality of light-receiving elements 52 are disposed in one line with intervals in the left-and-right direction along the bottom face of the heating compartment 10. Alternatively, the disposition of the light-receiving elements is not limited to the above one, and it is also allowable to dispose a plurality of light-receiving elements in two or more lines with intervals in the back-and-forth direction along the bottom face of the heating compartment and moreover dispose a plurality of light-receiving elements in two or more lines with intervals in the left-and-right direction along the bottom face of the heating compartment, or it is further allowable to dispose a plurality of light-receiving elements in a grid-like shape or in a concentric shape.

In the first embodiment, the material of the bottom tray 30 is set as a ceramic that transmits infrared rays. However, available as ceramics which transmit near infrared rays (generally called heat-resistant glass) are, for example, Neoceram (registered trademark made by Nippon Electric Glass Co., Ltd.) for use in ovens, IH (Induction Heating) cooking devices, quartz glass, Pyrex (registered trademark made by Corning Incorporated), and the like. In addition, whereas such ceramics whose color is white are infrared-transmittable, those having black color are non infrared-transmittable and therefore unusable.

For example, Neoceram has enough transmissivity in the infrared region as the material of the bottom tray 30 (see "Varieties of Glasses," Dec. 11, 2012, Internet URL: http://www.glass-dictionary.com/tainetu/neoseramu).

Also in the first embodiment, it is also possible to perform the detection of food weight through the steps of performing detection of food weight without turning on the indoor light 40, which is the light source to store output data of the individual light-receiving elements 52 as information about scattered light from the external, then performing detection of food weight with the indoor light 40 lit, calculating a difference from a first-stored output of disturbance light, and performing detection of food weight based on the resulting difference. By periodically performing the detection of food weight for obtainment of information about scattered light from the external, it becomes possible to correct dirts of the bottom tray 30 or secular changes of light-reception sensitivity of the light-receiving elements so that mis-recognitions can be prevented, with the reliability improved.

It is also allowable that at a rotational angle at which the light-reception intensity has come to a large one along with the rotation of the rotating antenna 81 during the detection of food weight, the light-source indoor light 40 is turned off, where if the light-reception intensity does not change, the increase in light-receiving intensity may be decided as being due to disturbance light.

Also, when the food is not taken out from within the heating compartment 10 whereas the door has been opened after an end of cooking, leaving-behind of food can be securely prevented by executing detection of the presence or absence of any food, where if a food is present, the user is notified of the presence of the food by display or audio for a specified time duration or more.

(Measured Data)

The present inventor verified by actual measurements that with a constitution similar to that of the above-described heating cooker, part of light (mostly infrared rays) emitted from the indoor light 40, which was transmitted by the bottom tray 30, was able to be received, through one turn of the rotating antenna 81, by the sensor parts S1, 32 placed on the lower side of the rotating antenna 81. Measured data in this case will be described below.

FIGS. 9 to 18 show results of actual measurements performed with the sensor parts S1, S2 disposed in the left-right direction (X-axis direction) on the lower side of the rotating antenna 81. It is noted that the rotating antenna 81 is assumed to be set at an initial position (with rotational angle of 0 deg).

Figure 9:
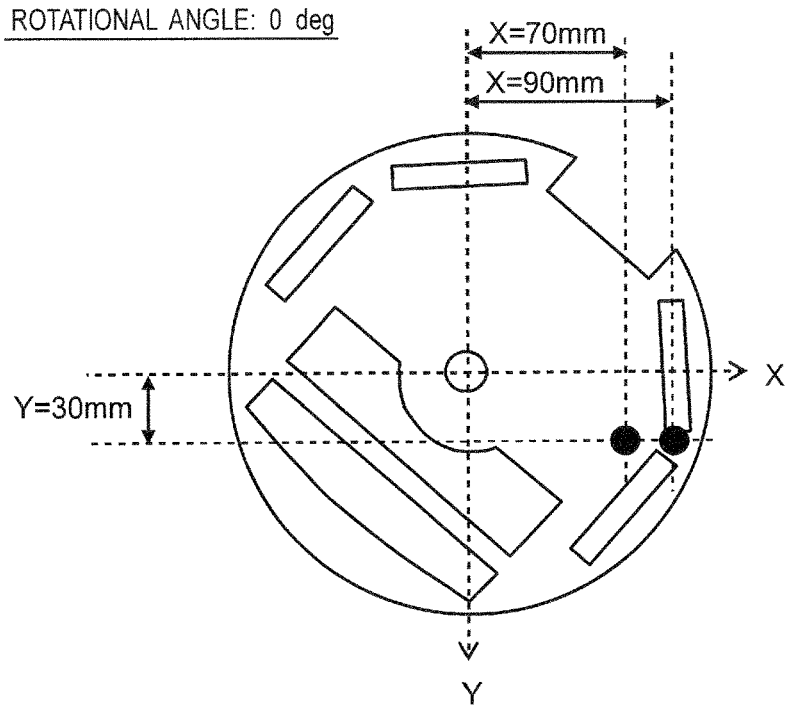
FIG. 9 is a schematic view in which the sensor parts are disposed along a left-right direction, as an example, in an initial position (with a rotating angle of 0 deg) of the rotating antenna.

FIG. 9 shows an example in which the sensor parts S1, 32 are disposed along the left-right direction in the initial position (with rotating angle 0 deg) of the rotating antenna.

Figure 10:
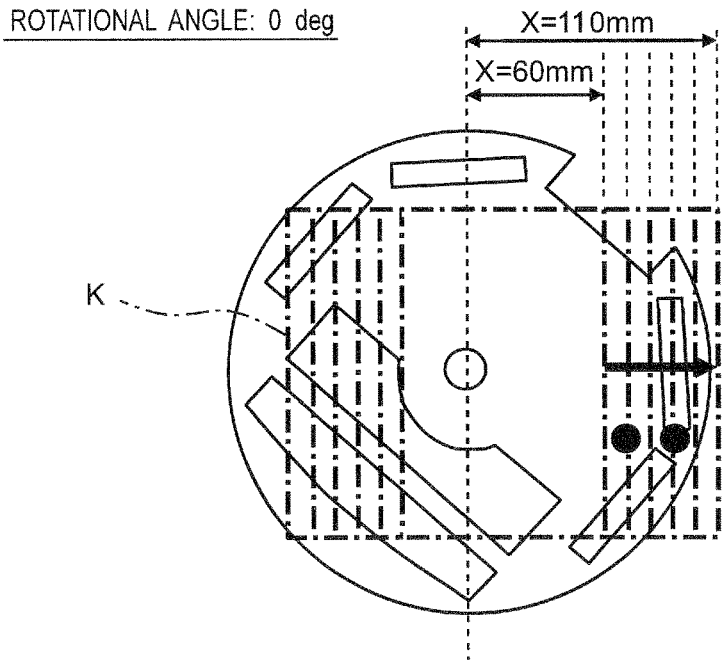
FIG. 10 is a schematic view showing a state in which a heating object, which is an article to be heated, has been moved along the X axis in the disposition of the sensor parts shown in FIG. 9.

First, FIG. 10 shows a state in which a heating object K has been moved in steps of 10 mm rightward along the X axis (left-and-right direction) in the disposition of the sensor parts S1, S2 shown in FIG. 9.

Figure 11:
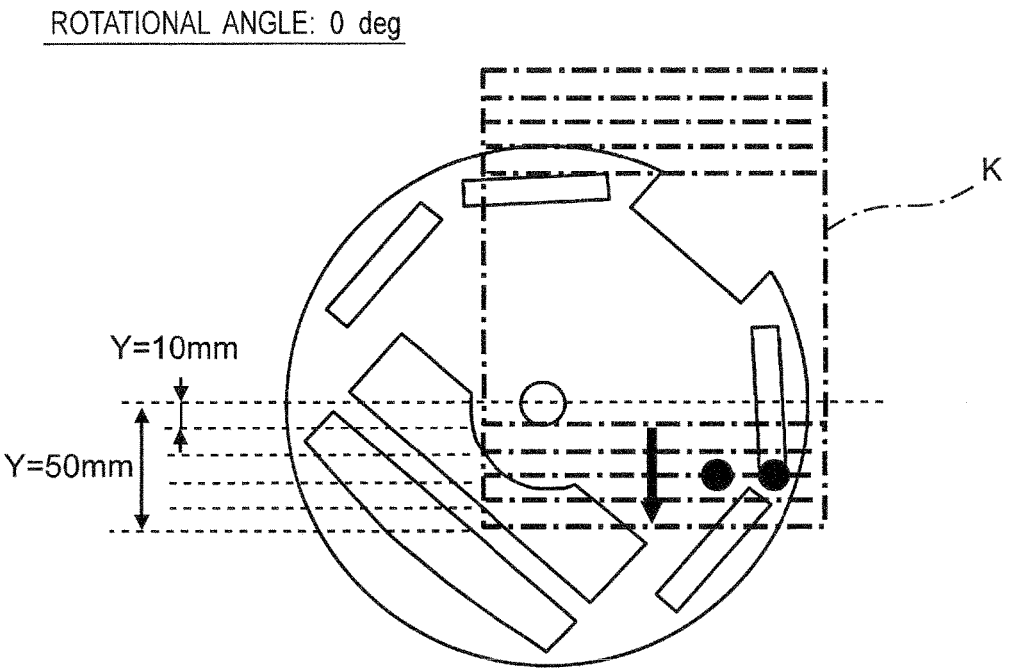
FIG. 11 is a schematic view showing a state in which a heating object has been moved forward along the Y axis in the disposition of the sensor parts shown in FIG. 9.

FIG. 11 shows a state in which the heating object K has been moved in steps of 10 mm along the Y axis (back-and-forth direction) in the disposition of the sensor parts S1, S2 shown in FIG. 9.

Figure 12:
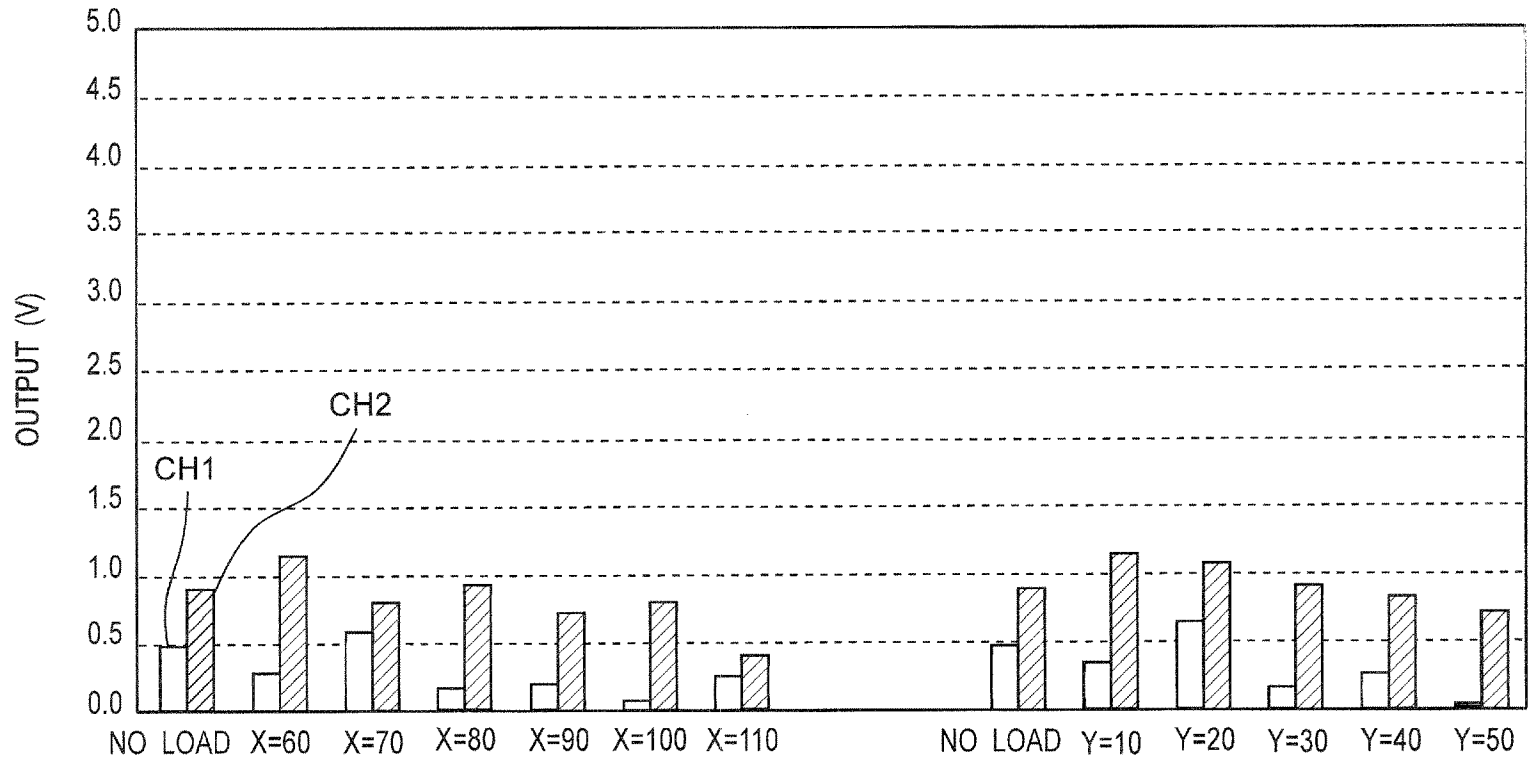
FIG. 12 is a chart showing relationships between positions of the heating object and outputs of the sensor parts in FIGS. 10 and 11.

FIG. 12 shows relationships between the positions of the heating object K and the outputs of the sensor parts S1, S2 in FIGS. 10 and 11, where left-hand bars represent outputs of the sensor part S1 while right-hand bars (hatched by slanted lines) represent outputs of the sensor part S2. In FIG. 12, the vertical axis represents outputs (V) of the sensor parts S1, S2, and the term no load' refers to a state that no heating object K is present.

Figure 13:
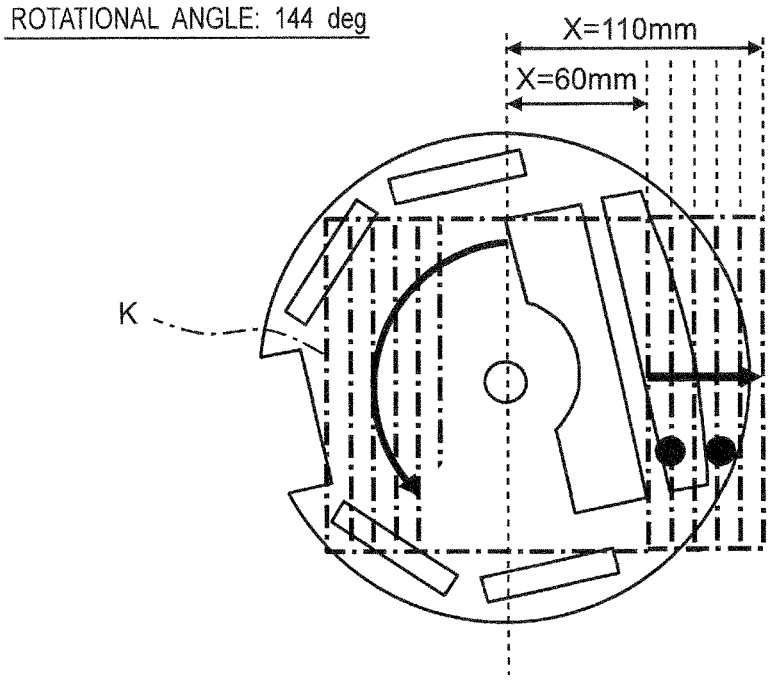
FIG. 13 is a schematic view showing a state in which a heating object has been moved rightward along the X axis in a position of the rotating antenna that has been rotated counterclockwise by a rotating angle of 144 deg from its initial position.

Also, FIG. 13 shows a state in which the heating object K has been moved in steps of 10 mm rightward along the X axis (left-and-right direction) in a position of the rotating antenna 81 that has been rotated counterclockwise to a rotational angle of 144 deg from the initial position.

Figure 14:
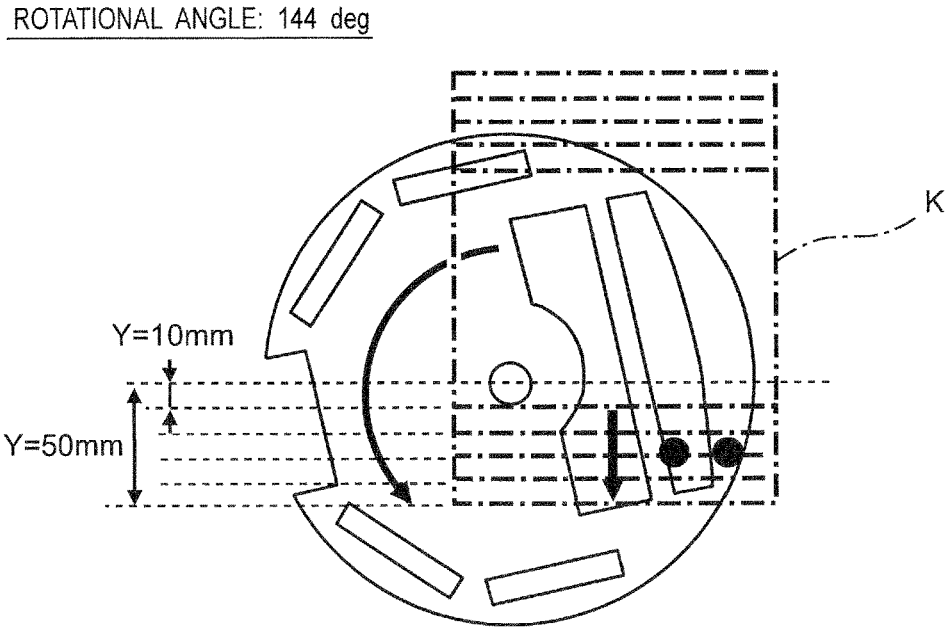
FIG. 14 is a schematic view showing a state in which a heating object has been moved forward along the Y axis in a position of the rotating antenna that has been rotated counterclockwise by a rotating angle of 144 deg from its initial position.

FIG. 14 shows a state in which the heating object K has been moved in steps of 10 mm forward along the Y axis (back-and-forth direction) in a position of the rotating antenna 81 that has been moved counterclockwise to a rotational angle of 144 deg from the initial position.

Figure 15:
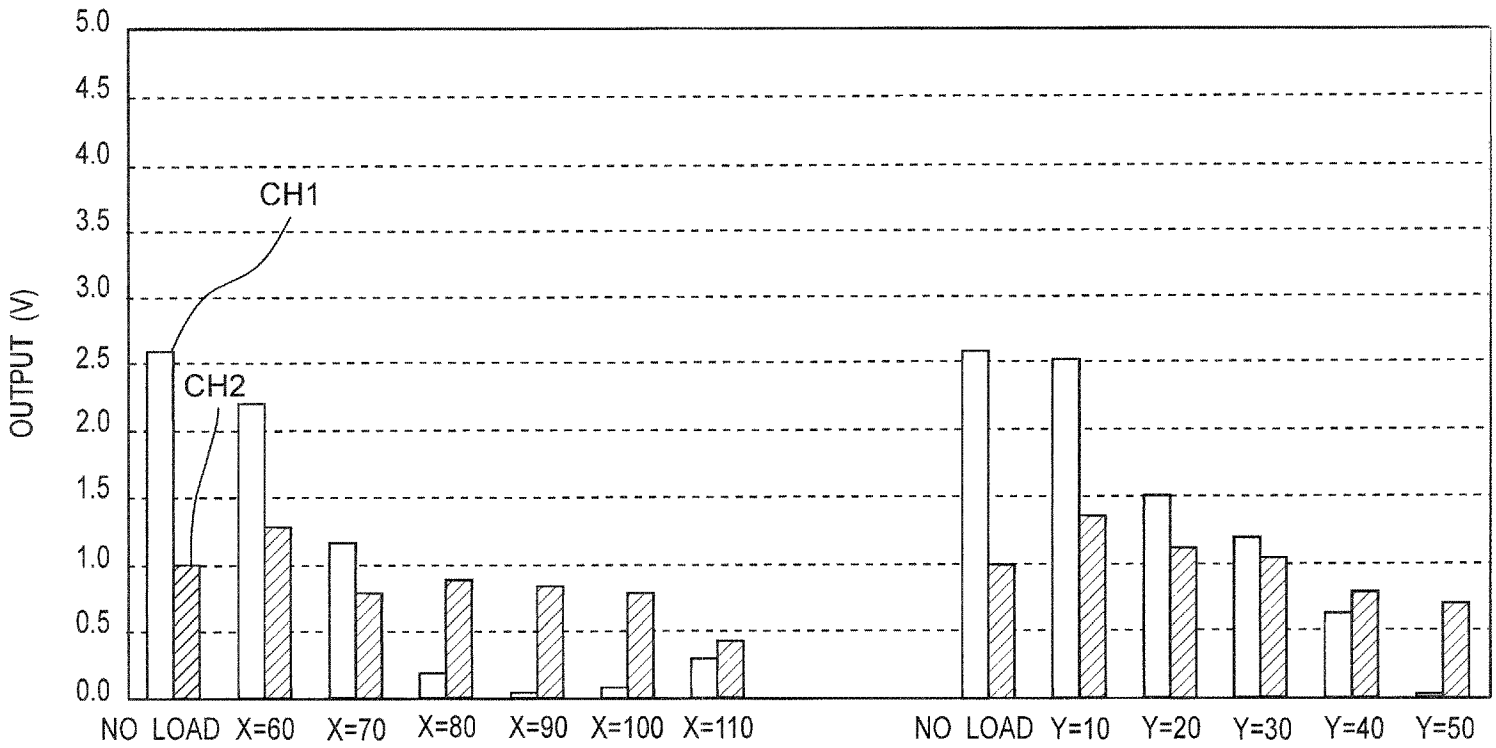
FIG. 15 is a chart showing relationships between positions of the heating object and outputs of the sensor parts in FIGS. 13 and 14.

FIG. 15 shows relationships between the positions of the heating object K and the outputs of the sensor parts S1, S2 in FIGS. 13 and 14, where left-hand bars represent outputs of the sensor part S1 while right-hand bars (hatched by slanted lines) represent outputs of the sensor part S2. In FIG. 15, the vertical axis represents outputs (V) of the sensor parts S1, S2, and the term 'no load' refers to a state that no heating object K is present.

Figure 16:
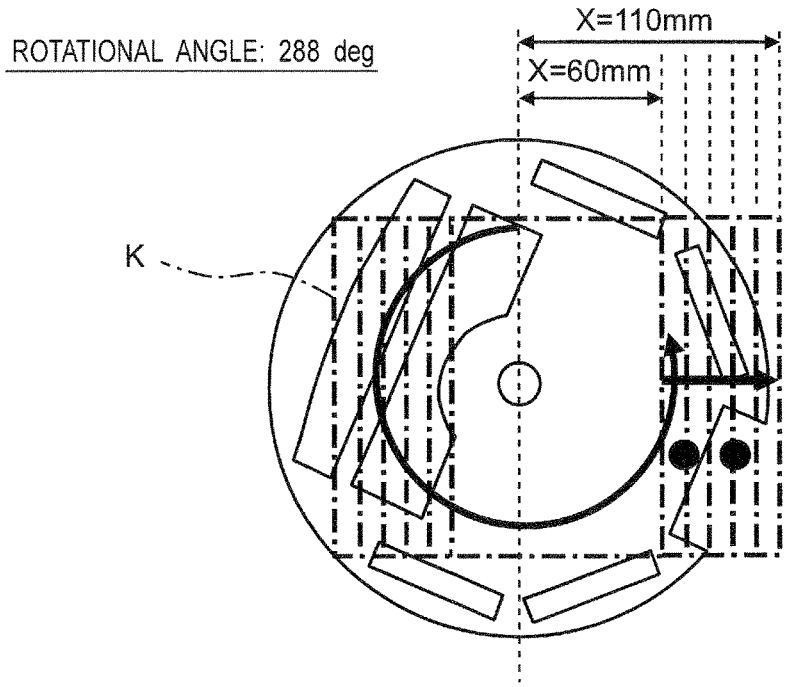
FIG. 16 is a schematic view showing a state in which a heating object has been moved rightward along the X axis in a position of the rotating antenna that has been rotated counterclockwise by a rotating angle of 288 deg from its initial position.

Further, FIG. 16 is a schematic view showing a state in which the heating object K has been moved rightward in steps of 10 mm along the X axis (left-and-right direction) in a position of the rotating antenna 81 that has been rotated counterclockwise by a rotating angle of 288 deg from the initial position.

Figure 17:
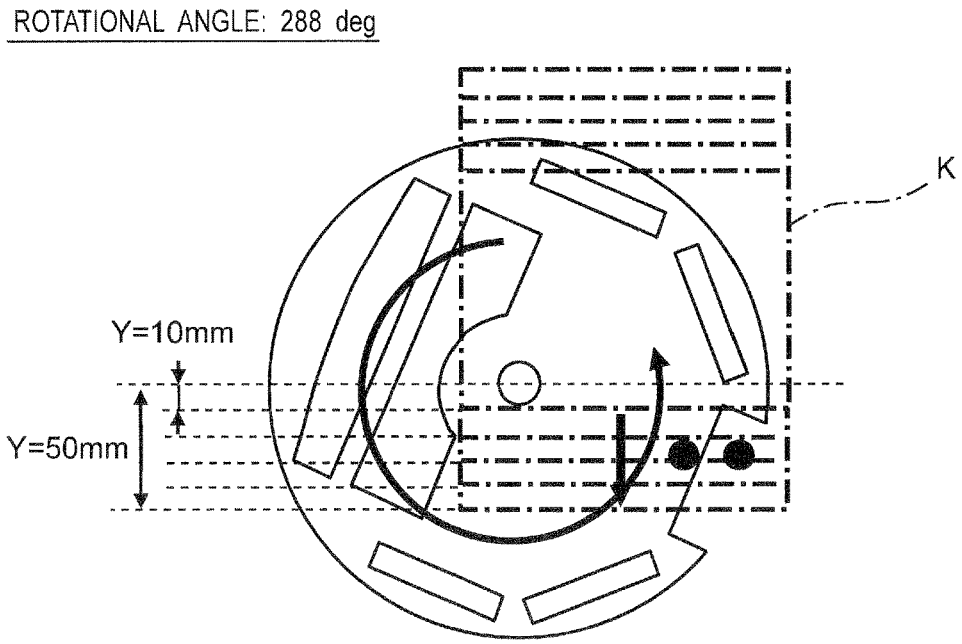
FIG. 17 is a schematic view showing a state in which a heating object has been moved forward along the Y axis in a position of the rotating antenna that has been rotated counterclockwise by a rotating angle of 288 deg from its initial position.

FIG. 17 shows a state in which the heating object K has been moved forward in steps of 10 mm along the Y axis (back-and-forth direction) in a position of the rotating antenna 81 that has been rotated counterclockwise by a rotational angle of 288 deg from the initial position.

Figure 18:
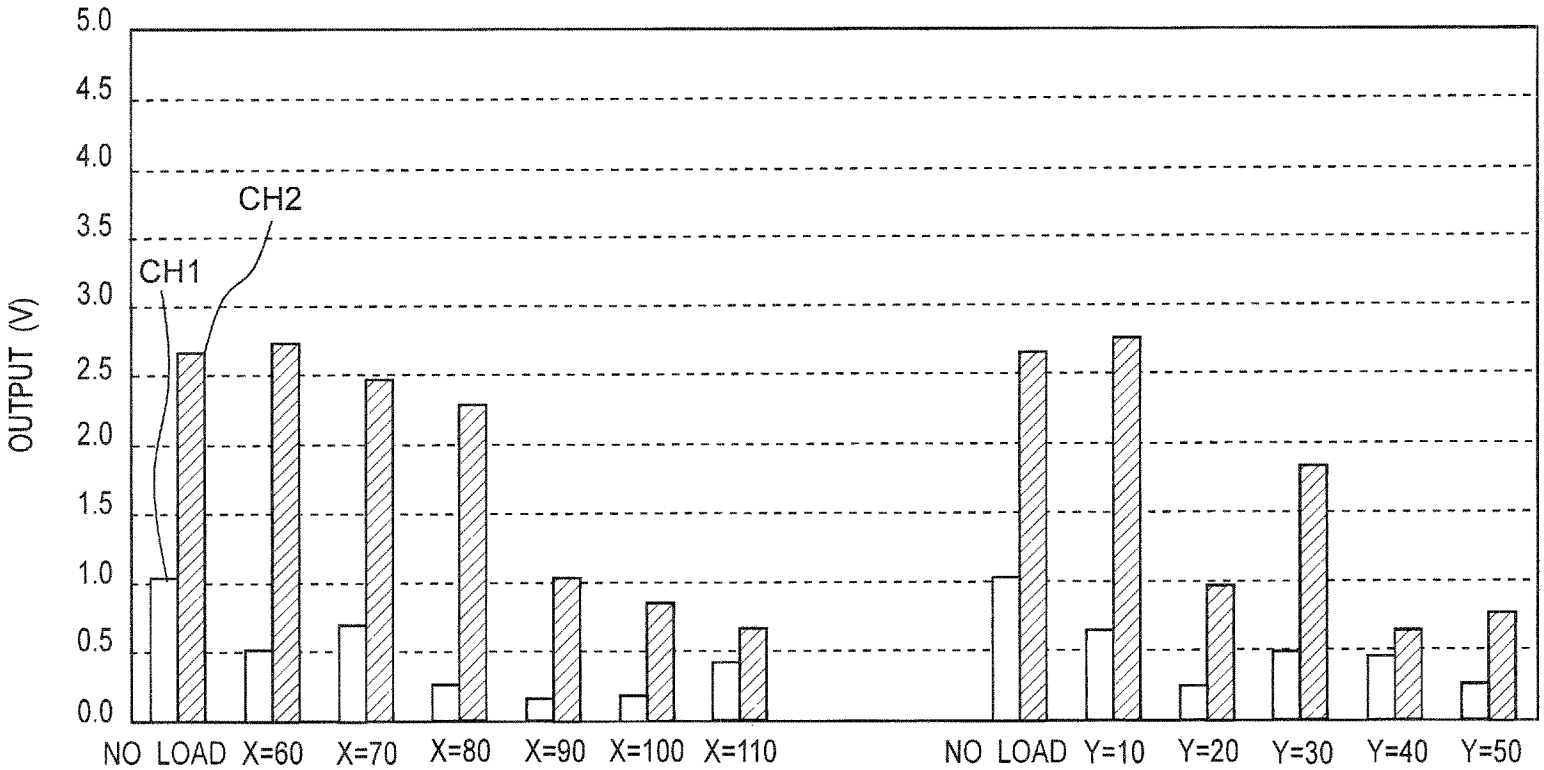
FIG. 18 is a chart showing relationships between positions of the heating object and outputs of the sensor parts in FIGS. 16 and 17.

FIG. 18 shows relationships between the positions of the heating object K and the outputs of the sensor parts S1, S2 in FIGS. 16 and 17, where left-hand bars represent outputs of the sensor part S1 while right-hand bars (hatched by slanted lines) represent outputs of the sensor part S2. In FIG. 18, the vertical axis represents outputs (V) of the sensor parts S1, S2, and the term no load' refers to a state that no heating object K is present.

Under the condition that the sensor parts S1, S2 are disposed in the left-and-right direction (X-axis direction), as apparent from FIGS. 12, 15 and 18, in any one of the rotational positions (those with rotational angles 144 deg, 288 deg in this measurement) of the rotating antenna 81, enough output voltages are obtained from the sensor parts S1, S2 that have received light (mostly infrared rays) transmitted by the bottom tray 30 out of light emitted from the indoor light 40, so that output voltages of the sensor parts S1, S2 that have received no light can be discriminated therefrom.

Figure 19:
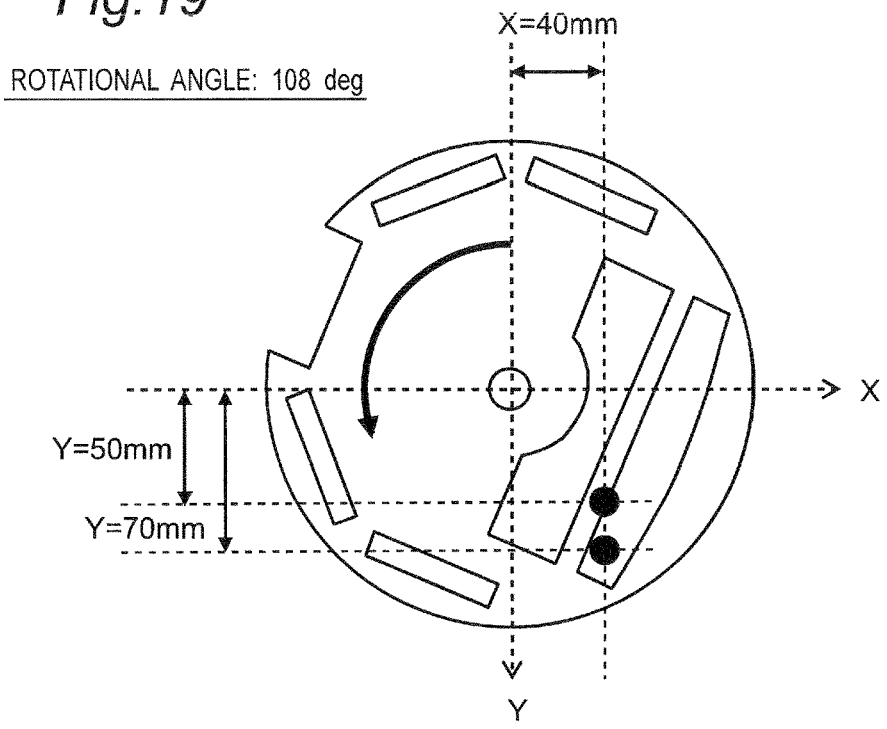
FIG. 19 is a schematic view showing an example in which the sensor parts are disposed along a back-and-forth direction in a position of the rotating antenna that has been rotated counterclockwise by a rotating angle of 108 deg from its initial position.
Figure 20:
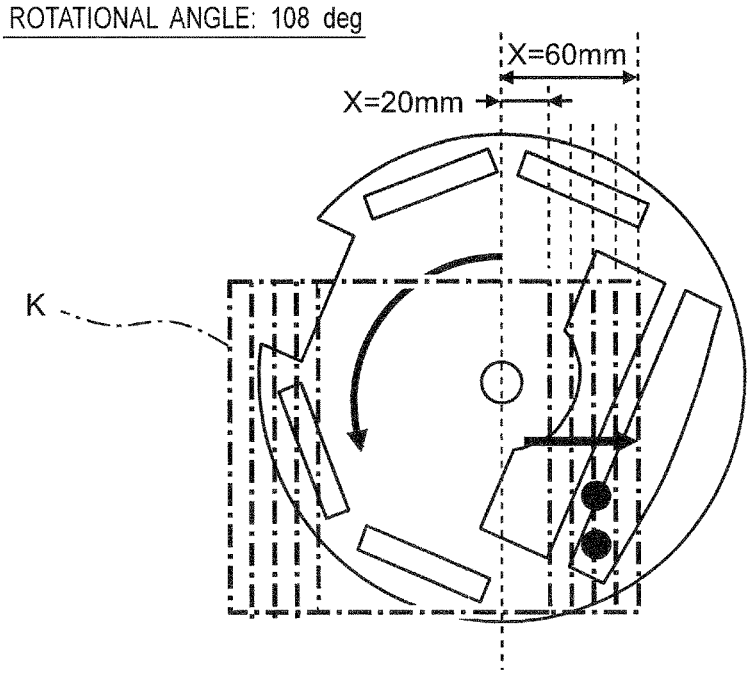
FIG. 20 is a schematic view showing a state in which a heating object has been moved rightward along the X axis in the disposition of the sensor parts shown in FIG. 19.
Figure 21:
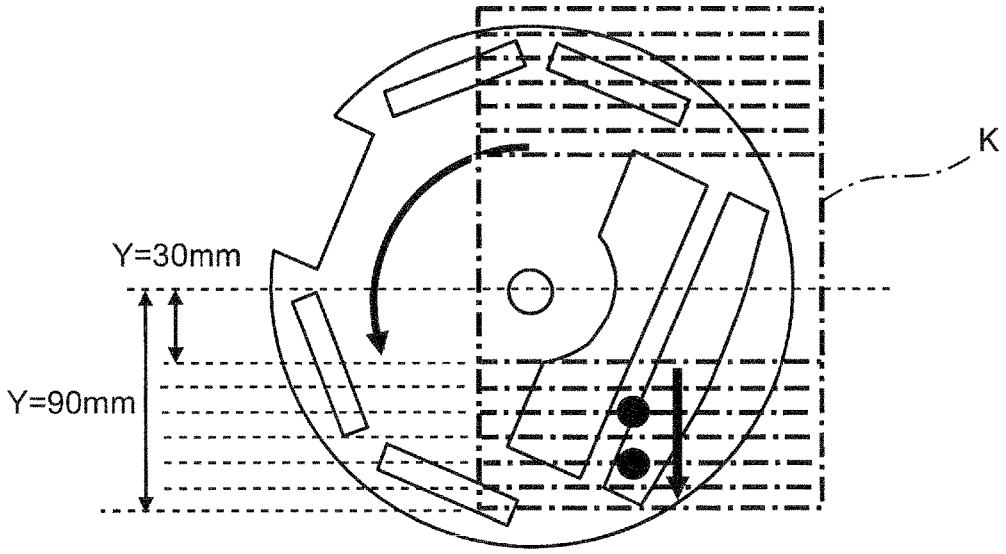
FIG. 21 is a schematic view showing a state in which a heating object has been moved forward along the Y axis in the disposition of the sensor parts shown in FIG. 19.

Also, FIGS. 19 to 21 show results of actual measurements performed with the sensor parts S1, S2 disposed in the back-and-forth direction (Y-axis direction) on the lower side of the rotating antenna 81.

FIG. 19 is a schematic view showing an example in which the sensor parts S1, S2 are disposed along the back-and-forth direction (Y-axis direction) in a position of the rotating antenna 81 that has been rotated counterclockwise by a rotating angle of 108 deg from the initial position.

FIG. 20 shows a state in which the heating object K has been moved rightward in steps of 10 mm along the X axis (left-and-right direction) in the disposition of the sensor parts S1, S2 shown in FIG. 19.

FIG. 21 shows a state in which the heating object K has been moved forward in steps of 10 mm along the Y axis (back-and-forth direction) in the disposition of the sensor parts S1, S2 shown in FIG. 19.

Figure 22:
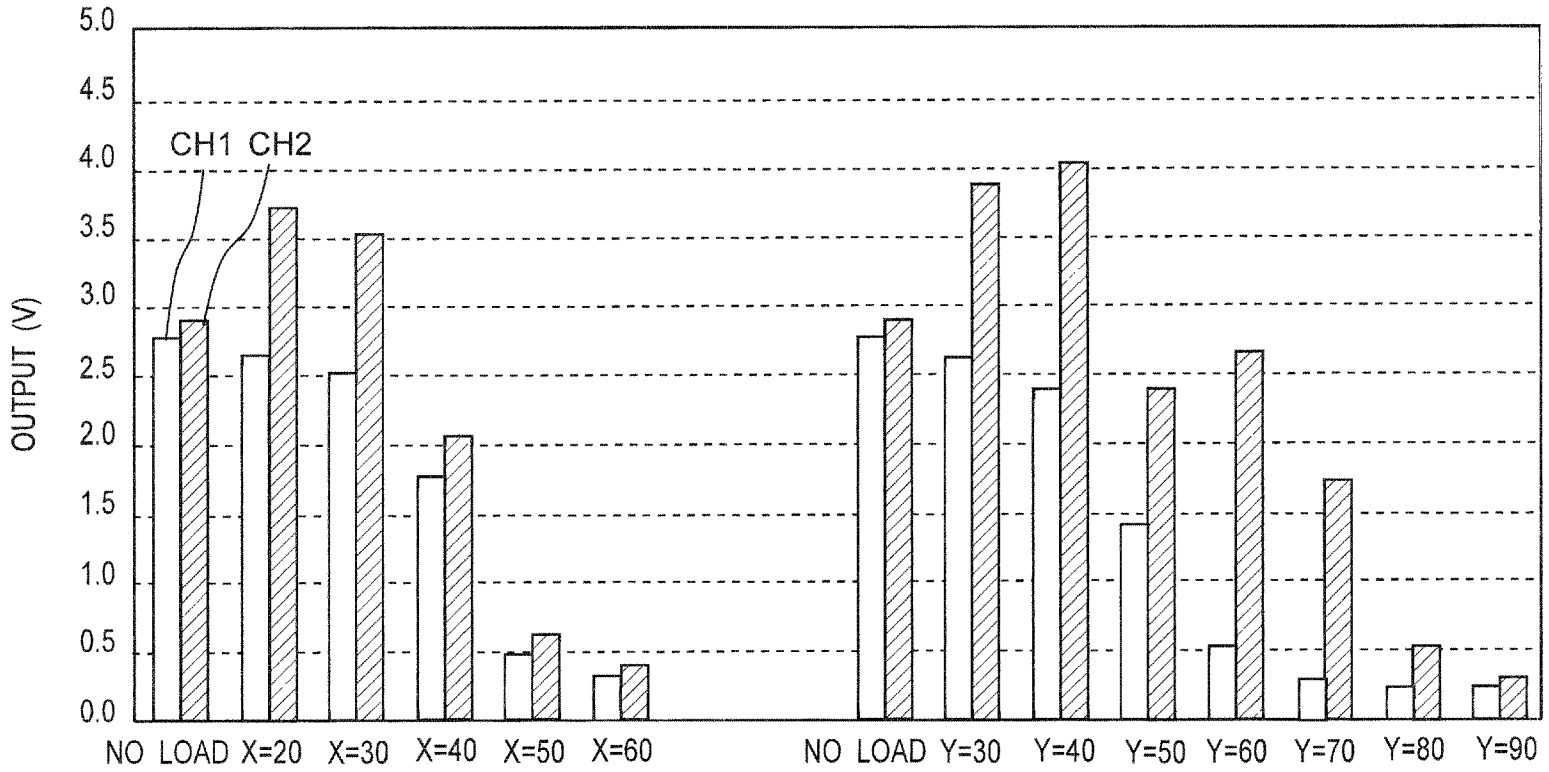
FIG. 22 is a chart showing relationships between positions of the heating object and outputs of the sensor parts in FIGS. 20 and 21.

FIG. 22 shows relationships between the positions of the heating object K and the outputs of the sensor parts S1, S2 in FIGS. 20 and 21, where left-hand bars represent outputs of the sensor part S1 while right-hand bars (hatched by slanted lines) represent outputs of the sensor part S2. In FIG. 22, the vertical axis represents outputs (V) of the sensor parts S1, S2, and the term 'no load' refers to a state that no heating object K is present.

Under the condition that the sensor parts S1, S2 are disposed in the back-and-forth direction (Y-axis direction), as apparent from FIG. 22, in any one of the rotational positions (that with rotational angle 108 deg in this measurement) of the rotating antenna 81, enough output voltages are obtained from the sensor parts S1, S2 that have received light (mostly infrared rays) transmitted by the bottom tray 30 out of light emitted from the indoor light 40, so that output voltages of the sensor parts S1, S2 that have received no light can be discriminated therefrom.

(Second Embodiment)

Next, a heating cooker according to a second embodiment of this invention will be described below. The heating cooker of this second embodiment is identical in constitution to the heating cooker of the first embodiment except the light source and therefore FIGS. 1 to 7 are applied also in this case.

In the heating cooker of the second embodiment, a light-emitting element as an example of a light source that emits near infrared rays is provided on the upper and outer side of the right side wall in the heating compartment 10 independent of the indoor light 40, unlike the first embodiment using the indoor light 40 as a light source.

According to the heating cooker of the second embodiment, at a start of heat cooking, by turning on the light-emitting element with the indoor light 40 off, the determining part 200*a* of the control unit 200 determines the presence/absence or size of a heating object set on the bottom tray 30 within the heating compartment 10 based on outputs of the sensor parts $S_0$, $S_X$), $S_{X2}$, $S_{X2}$, $S_{Y1}$, $S_{Y2}$.

In this second embodiment, even if the presence/absence or size of a heating object is determined during heat cooking, the infrared rays emitted from the light-emitting element serving as the light source are invisible and therefore the user seeing the lighting of the indoor light 40, which would be thought being normally off, is prevented from sensing incompatibility. Thus, misunderstanding as a fault or the like can be prevented.

(Third Embodiment)

Next, a heating cooker according to a third embodiment of this invention will be described below. The heating cooker of this third embodiment is identical in constitution to the heating cooker of the first embodiment except the disposition of the light-emitting element and the rotation of the rotating antenna and therefore FIGS. 1 to 7 are applied also in this case.

In the heating cooker of the third embodiment, a plurality of light-receiving elements are disposed on the top face of the rotating antenna 81. In this case, the plurality of light-receiving elements that rotate along with the rotating antenna 81 receive light derived from the indoor light 40 and transmitted by the bottom tray 30 without being intercepted by the rotating antenna 81.

In addition, in this heating cooker, the rotating antenna 81 is repeatedly rotated for 360-deg forward and reverse rotations alternately, unlike the first embodiment in which the rotating antenna 81 is rotated in one direction (clockwise direction). As a result of this, the reliability of interconnections between the light-receiving elements rotating along with the rotating antenna 81 and the control unit 200 can be improved and moreover a simplified interconnecting structure can be fulfilled.

According to the heating cooker of the third embodiment, since the plurality of light-receiving elements are rotated along with the rotating antenna 81, it becomes possible to scan the light-receiving position in a circular or circular-arc shape by one light-receiving element as an example. Thus, the size of the heating object can be discriminated accurately with less-quantity light-receiving element.

For the heating cooker of the third embodiment, a plurality of light-emitting elements as the light source instead of the indoor light 40 may be disposed on the top face of the rotating antenna 81. With the structure in which light is irradiated from the light source located in upper portion of the heating compartment, the bottom tray may have thereon regions to which light is less likely to reach due to large distance from the light source, or light may be intercepted due to large height of heating objects so that blind spots may occur. In contrast to this, with a plurality of light-emitting elements disposed on the top face of the rotating antenna 81, light is irradiated from below the bottom tray, eliminating blind spots, so that the size of a heating object can be detected with higher accuracy.

(Fourth Embodiment)

Next, a heating cooker according to a fourth embodiment of this invention will be described below. The heating cooker of this fourth embodiment is identical in constitution to the heating cooker of the first embodiment except the light source and therefore FIGS. 1 to 7 are applied also in this case.

In the heating cooker of the fourth embodiment, a light-emitting element as an example of the light source is placed at a bottom portion of the antenna chamber 31. In addition, this light-emitting element irradiates infrared rays from below the bottom tray 30 toward the bottom face side of the heating object set on the bottom tray 30. Then, the light-receiving elements 52 of the sensor parts $S_0$, $S_{X1}$, $S_{X2}$, $S_{X3}$, $S_{Y1}$, $S_{Y2}$ placed on the lower side of the rotating antenna 81 receive, via the bottom tray 30, light reflected from the bottom face side of the heating object.

In the heating cooker of the fourth embodiment, it is allowable to use a light-emitting element for emitting light of a wavelength region stretching over infrared and visible regions so that when the door 2 is opened, the light-emitting element is irradiated from below the bottom tray 30 to illuminate the center of the food set position on the bottom tray 30. As a result of this, the user can be alerted to the food set position, so that the user is enabled to place the food to the set position set more effectively than by guidance of instruction manual or the like.

In the above-described first to fourth embodiments, food weight is detected for thawing cooking using microwaves. However, food weight detection may be done for cooking in which the food is set on the bottom tray within the heating compartment without using tableware or the like.

Also, the heating cooker of this invention may be applied to not only microwave ovens with bakery functions using superheated steam but also microwave ovens of the microwave heating method, ovens with bakery functions using superheated steam, microwave ovens with bakery functions using no superheated steam, ovens using no superheated steam, and the like.

The heating cooker of the invention is enabled to perform healthy cooking by using superheated steam or saturated steam. For example, with the heating cooker of the invention, since superheated steam or saturated steam of 100° C. or higher temperatures is supplied to food surfaces so that superheated steam or saturated steam adhering to the food surfaces is condensed to impart a large amount of condensed latent heat to the food, heat can be transferred to the food with high efficiency. Also, since condensed water adheres to food surfaces so that salinity and oil contents drip down along with the condensed water, salinity and oil contents in the food can be reduced. Further, since the interior of the heating compartment is filled with superheated steam or saturated steam so as to come to a low-oxygen state, cooking in which oxidation of foods is suppressed can be fulfilled, It is noted here that the term 'low-oxygen state' refers to a state in which the volumetric percentage of oxygen in the heating compartment is 10% or lower (e.g., 0.5 to 3%).

Although specific embodiments of the present invention have been described hereinabove, the invention is not limited to the above embodiments and may be carried out with various changes and modifications without departing from the scope of the invention.

Consequently, the invention and its embodiments can be summarized as follows.

The heating cooker according to the present invention comprises:

a heating compartment 10;

a bottom tray 30 having light transmittability and attached to a bottom portion of the heating compartment 10;

a light source 40 provided on an upper side of the heating compartment 10 or on a lower side of the bottom tray 30;

at least one light-receiving element 52 which is provided on the lower side of the bottom tray 30 and which receives light transmitted by the bottom tray 30 out of light emitted from the light source 40; and a determining part 200*a* for, based on a light-reception signal detected by the light-receiving element 52, determining presence/absence or size of a heating object set on the bottom tray 30 within the heating compartment 10.

In this case, the bottom tray 30 needs only to have enough light transmittability to transmit light of a partial wavelength region such as infrared region out of the whole wavelength region.

With this constitution, the light-receiving element 52 for receiving light transmitted by the bottom tray 30 out of light emitted from the indoor light 40 is provided on the lower side of the bottom tray 30 attached to the bottom portion of the heating compartment 10 and, based on a light-reception signal detected by the light-receiving element 52, the determining part 200*a* determines the presence/absence or size of a heating object set on the bottom tray 30 within the heating compartment 10. As a result of this, there can be realized a heating cooker capable of detecting the presence or absence of a food in the heating compartment 10 while preventing steam leaks even in heat cooking with use of steam.

In the heating cooker according to one embodiment, the heating cooker has a plurality of light-receiving elements 52.

According to this embodiment, since the plurality of light-receiving elements 52 are arrayed with intervals along the bottom face of the heating compartment 10, not only the presence or absence of a heating object but also the size of a heating object can be detected.

Also, the heating cooker according to one embodiment further comprises a heat insulating member 32 provided on the lower side of the bottom tray 30 with a gap therebetween, wherein the light-receiving element is disposed at a bottom portion of a recess 51 extending through the heat insulating member 32.

According to this embodiment, recesses 51 extending through the heat insulating member 32 provided on the lower side of the bottom tray 30 with a gap therebetween are provided, and the light-receiving elements 52 are disposed at bottom portions of the recesses 51. As a result of this, the light-receiving elements 52 can be prevented from incurring reliability degradation and damage of the light-receiving elements 52 due to exposure to high heat of the heating compartment 10.

Also, the heating cooker according to one embodiment further comprises:

an antenna chamber 31 provided on the lower side of the bottom tray 30 in the heating compartment 10; and a rotating antenna 81 rotatably attached in the antenna chamber 31 and having a plurality of openings, wherein the light-receiving element 52 is disposed on a lower side of the rotating antenna 81, and the light-receiving element 52 placed inner than an outer peripheral edge of the rotating antenna 81 is located at such a position as to be enabled to receive light, which is derived from within the heating compartment 10 and transmitted by the bottom tray 30, via a region of a rotational locus of the openings of the rotating antenna 81.

With this constitution, the light-receiving element 52 is placed on the lower side of the rotating antenna 81 rotatably attached in the antenna chamber 31, and the light-receiving element 52 placed inner than the outer peripheral edge of the rotating antenna 81 is located at such a position as to receive light, which is derived from within the heating compartment 10 and transmitted by the bottom tray 30, via the region of the rotational locus of the openings of the rotating antenna 81. As a result of this, the rotating antenna 81 is rotated by at least one turn so that the light-receiving elements 52 placed inner than the outer peripheral edge of the rotating antenna 81 are also enabled to determine the presence/absence (and/or size) of the heating object. Thus, a heating object set in an area on the bottom face within the heating compartment 10 and facing the rotating antenna 81 can be detected.

Also, in the heating cooker according to one embodiment, at a start of heat cooking, the determining part 200*a* turns on the light source 40 and determines presence/absence or size of the heating object set on the bottom tray 30 within the heating compartment 10.

According to this embodiment, since the determining part 200*a*, at a start of heat cooking, turns on the light source 40 and determines presence/absence or size of the heating object set on the bottom tray 30 within the heating compartment 10, heating can be stopped on condition that no heating object is present at a start of heat cooking and moreover heat cooking can be performed with heating conditions (e.g., food weight) set based on the size of the heating object at a start of heat cooking.

Also, in the heating cooker according to one embodiment, a plurality of the light-receiving elements 52 are disposed in at least one line with intervals in a back-and-forth direction along the bottom face of the heating compartment 10, and a plurality of the light-receiving elements 52 are disposed in at least one line with intervals in a left-and-right direction along the bottom face of the heating compartment 10.

According to this embodiment, a plurality of the light-receiving elements 52 are disposed in at least one line with intervals in the back-and-forth direction along the bottom face of the heating compartment 10, and a plurality of the light-receiving elements 52 are disposed in at least one line with intervals in the left-and-right direction along the bottom face of the heating compartment 10. By virtue of this disposition, the size of the heating object set on the bottom tray 30 within the heating compartment 10 can be detected in divided multiple steps.

REFERENCE SIGNS LIST

1 casing
2 door
3 handle
4 heat-resistant glass
5 operation panel
6 color LCD part
7 button group
8 exhaust duct cover
9 dew receiving container
10 heating compartment
11 water supply tank
12 steam generator
13 steam supply passage
13*a* steam supply port
14 circulation unit
14*a* steam supply port
16 cooling-fan motor
17 electrical equipment part
18 circulation fan
19 circulation-fan motor
20 superheated steam generation heater
21 superheated steam generator
22 steam supply port
24 first steam blowoff hole
25 second steam blowoff hole
28 suction port
29 interior temperature sensor
30 bottom tray
31 antenna chamber
32 heat insulating member
39*a*, 39*b*, 39*c* engaging portion
40 indoor light
44 air-supply-damper motor
50 thawing sensor
51 tubular light guide path
52 light-receiving element
60 exhaust-air-damper motor
70 water supply pump
80 magnetron
81 rotating antenna
81*a* rotating shaft
82 rotating-antenna motor
100 steam duct
110 first duct portion
120 bent portion
130 second duct portion
140 tray
150 net
160, 162, 163, 164, 165-1, 165-2, 166-1, 166-2, K heating object
180 exhaust duct
200 control unit
200*a* determining part
$S_{ALL}$, food detection sensor group
$S_0$, $S_{X1}$, $S_{X2}$, $S_{X3}$, $S_{Y1}$, $S_{Y2}$, S1, S2 sensor part

The invention claimed is:

1. A heating cooker comprising:

a heating compartment;

a bottom tray having light transmittability and attached to a bottom portion of the heating compartment;

a light source provided on an upper side of the heating compartment or on a lower side of the bottom tray;

at least one light-receiving element which is provided on the lower side of the bottom tray and which receives light transmitted by the bottom tray out of light emitted from the light source;

a determining part for, based on a light-reception signal detected by the at least one light-receiving element, determining presence/absence or size of a heating object set on the bottom tray within the heating compartment;

a magnetron which generates microwave to be provided to the heating compartment;

an antenna chamber provided on the lower side of the bottom tray in the heating compartment;

a rotating antenna rotatably mounted in the antenna chamber and having a plurality of openings for stirring the microwave from the magnetron, wherein the at least one light-receiving element is disposed on a lower side of the rotating antenna and inner than an outer peripheral edge of the rotating antenna to receive light, which is derived from within the heating compartment and transmitted by the bottom tray, via a region of a rotational locus of the openings of the rotating antenna.

2. The heating cooker as claimed in claim 1, wherein the heating cooker has a plurality of light-receiving elements.

3. The heating cooker as claimed in claim 1, further comprising a heat insulating member provided on the lower side of the bottom tray with a gap therebetween, wherein the at least one light-receiving element is disposed at a bottom portion of a recess extending through the heat insulating member.

4. The heating cooker as claimed in claim 1, wherein at a start of heat cooking, the determining part turns on the light source and determines presence/absence or size of the heating object set on the bottom tray within the heating compartment.

* * * * *